US006425587B1

(12) United States Patent
Moon

(10) Patent No.: US 6,425,587 B1
(45) Date of Patent: Jul. 30, 2002

(54) MULTI-FUNCTIONAL ROLLER SKATES

(76) Inventor: Aaron G. Moon, 1533 North, 160 West, Layton, UT (US) 84041

( * ) Notice: Subject to any disclaimer, the term of this patent is extended or adjusted under 35 U.S.C. 154(b) by 0 days.

(21) Appl. No.: 09/651,397

(22) Filed: Aug. 29, 2000

(51) Int. Cl.[7] ..... A63C 17/14

(52) U.S. Cl. ..... 280/11.206; 280/11.221

(58) Field of Search ..... 280/11.19, 11.221, 280/11.204, 11.211, 11.215, 11.216, 11.217, 11.208, 11.206, 11.209, 11.222, 11.231, 11.232, 809, 811, 7.12, 7.13, 7.14, 11.24, 11.225, 11.27, 11.28

(56) References Cited

U.S. PATENT DOCUMENTS

| | | | | |
|---|---|---|---|---|
| 1,632,997 A | * | 6/1927 | Connolly | 280/11.19 |
| 1,974,152 A | * | 9/1934 | Draws | 280/11.208 |
| 2,412,290 A | | 12/1946 | Rieske | |
| 2,552,987 A | * | 5/1951 | Loertz, Jr. | 280/11.27 |
| 3,010,732 A | | 11/1961 | Correll | |
| 3,104,887 A | | 9/1963 | Rice et al. | |
| 3,224,785 A | | 12/1965 | Stevenson | |
| 4,108,451 A | | 8/1978 | Scheck, Sr. | |
| 4,194,751 A | | 3/1980 | Shinmura | |
| 4,201,395 A | * | 5/1980 | Matejec et al. | 280/11.37 |
| 4,394,028 A | | 7/1983 | Wheelwright | |
| 4,417,737 A | | 11/1983 | Suroff | |
| 4,492,385 A | | 1/1985 | Olson | |
| 4,657,265 A | | 4/1987 | Ruth | |
| 4,817,974 A | * | 4/1989 | Bergeron | 280/11.209 |
| 4,932,675 A | | 6/1990 | Olson et al. | |
| 4,943,075 A | | 7/1990 | Gates | |
| 5,028,058 A | | 7/1991 | Olson | |
| 5,088,748 A | | 2/1992 | Koselka et al. | |
| 5,092,614 A | | 3/1992 | Malewicz | |
| 5,106,110 A | | 4/1992 | Williamson | |
| 5,171,032 A | | 12/1992 | Dettmer | |
| 5,171,033 A | | 12/1992 | Olson et al. | |
| 5,183,275 A | | 2/1993 | Hoskin | |
| 5,193,827 A | | 3/1993 | Olson | |
| 5,342,071 A | | 8/1994 | Soo | |
| 5,375,859 A | * | 12/1994 | Peck et al. | 280/11.2 |
| 5,405,156 A | * | 4/1995 | Gonella | 280/11.28 |
| 5,478,094 A | | 12/1995 | Pennestri | |
| 5,486,011 A | | 1/1996 | Nelson | |
| 5,501,474 A | | 3/1996 | Conte | |
| 5,527,048 A | * | 6/1996 | Conte | 280/112 |
| 5,967,552 A | * | 10/1999 | Roderick et al. | 280/843 |
| 6,070,886 A | * | 6/2000 | Cornelius et al. | 280/11.22 |
| 6,086,072 A | * | 7/2000 | Prus | 280/11.28 |

FOREIGN PATENT DOCUMENTS

| | | |
|---|---|---|
| DE | 42 22 326 A 1 | 2/1993 |
| EP | 551704 A2 | 7/1993 |

* cited by examiner

*Primary Examiner*—Brian L. Johnson
*Assistant Examiner*—G B Klebe
(74) *Attorney, Agent, or Firm*—Mallinckrodt & Mallinckrodt; Brian R. Rayve

(57) ABSTRACT

Mono-wheel roller skates having a single large main wheel which supports the skater and a pivotally mounted smaller brake actuation wheel which contacts the ground when the skates are tipped backward and which is operatively connected to caliper brakes which grip the main wheel to slow or stop the skater. The main wheel is treaded and spring-mounted on a cantilevered arm to absorb shocks for off-road skating. A removable rock guard works in conjunction with a built-in rail guard to deflect debris and prevent it from accumulating in front of the main wheel. An arcuate toe push-off piece or a unidirectionally rolling toe push-off wheel allows pushing off from the toe of the skate such that a skater can use an in-line skating stroke wherein the skates remain pointed in the direction of travel rather than angled outward thereto as is usually required for skating. A quick-release system comprising a plate mounted to the boot having short angled key sections which interlocks with mating slots in the support frame and pin in place allow the skater to quickly change from mono-wheel roller skate frames to in-line roller skate frames, tank tread, and bladed ice skate support frames. Both the in-line and the mono-wheel roller skates allow the use of multiple wheel sizes by means of slotted attachment points of the wheel axles to the supporting frames and cantilever arms.

9 Claims, 20 Drawing Sheets

MULTI-FUNCTIONAL ROLLER SKATES

BACKGROUND OF THE INVENTION

1. Field

Figure 1:
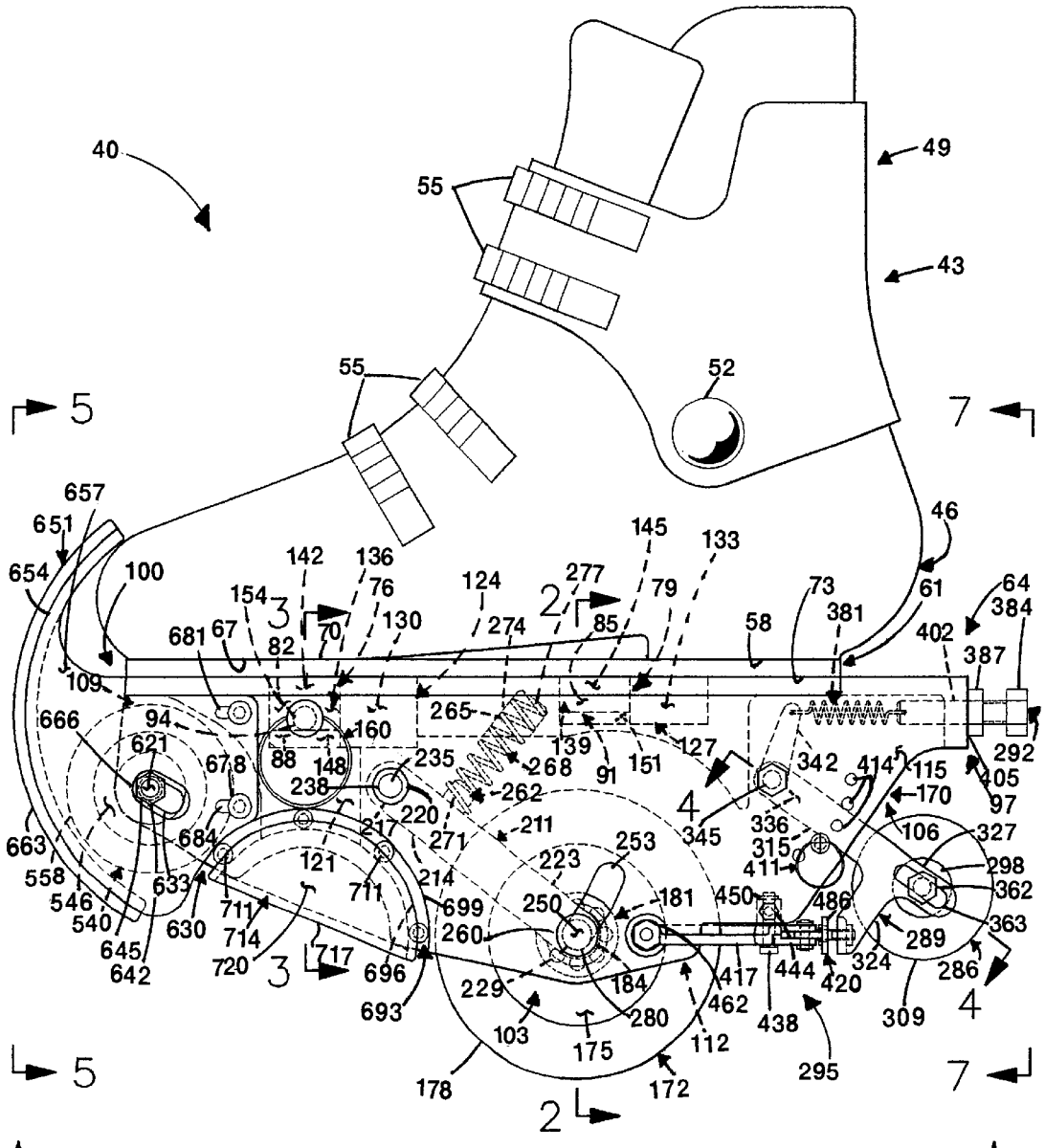

The invention relates to roller skates, and more specifically to in-line and mono-wheel roller skates.

2. State of the Art

There are a variety of roller skates which have been patented over the years. The first type of roller skates have front and rear wheel support frames or trucks pivotally attached to a base plate connectable to a shoe or boot, each truck carrying an axle to which were attached side-by-side a pair of rollers or wheels. The trucks are pivotally attached to the base such that when the boot attached to the base tilts the base relative to the wheels and the ground, the trucks with wheels turn laterally so as to effect a turn. The earliest versions of such skates have steel wheels and clamp directly to a conventional street shoe. The later versions have wheels with resilient tires and an ankle reinforcing shoe or boot fixedly attached thereto.

More recently, in an effort to provide roller skates which provide increased maneuverability similar to that of ice skating and better adapted for outdoors use, in-line roller skates were introduced. Typical in-line roller skates, though not the first, are disclosed in U.S. Pat. No. 5,092,614 issued to Malewicz which skates have a plurality of in-line rollers, typically four or five, along the longitudinal centerline of the skates to more closely simulate the blades of ice skates. Such in-line skates can be tilted at a farther angle off vertical than possible with trucks having side-by-side wheels so as to provide greater maneuverability. In-line skates, however, cannot be side-slipped nor snow-plowed as is done to slow or stop on ice skates due to the higher friction between the resilient wheels of roller skates against the ground than the metal blades of ice skates against ice.

Braking of in-line skates is typically accomplished by dragging a brake pad at the rear of the skate against the ground as is done in the Malewicz patent. Alternatives include U.S. Pat. No. 5,183,275 issued to Hoskin discloses hybrid dual braking mode skates wherein the brake pad at the rear of each skate pivots upon contacting the ground and simultaneously engages a roller which applies braking force to the adjacent rear wheel. U.S. Pat. No. 5,253,882 issued to Mitchell discloses a pivoting hand-actuated rear brake pad which pivots downwardly against the ground upon moving of a hand actuator, rather than tilting the skates backward to drag the brake pad on the ground.

Dragging a brake pad on the ground as a means to stop results in excessive wear to the brake pad which must frequently be replaced. In an effort to provide an improved means of braking skates, other devices have been used. In U.S. Pat. No. 5,501,474 issued to Conte, U.S. Pat. No. 5,478,094 issued to Pennestri, U.S. Pat. No. 5,342,071 issued to Soo, and U.S. Pat. No. 5,486,011 issued to Nelson are disclosed variations of in-line skates wherein the rearmost wheel is mounted on a spring-loaded arm such that when downward force is applied to the rearmost wheel, the arm pivots the rearmost wheel into contact with a fixed member so as to apply breaking force to the rearmost wheel. Similarly, U.S. Pat. No. 5,088,748 issued to Koselka et al. discloses skates with the rearmost wheel mounted on a spring-loaded arm but wherein as force is applied to the rearmost wheel as the arm pivots such that a separate braking member or link engages the second to the rearmost wheel to apply braking force thereto.

Other types of brakes have been used on roller skates and other skate-type devices in an effort to improve the braking thereof. For instance, in U.S. Pat. No. 5,171,032 issued to Dettmer is disclosed roller skates with hand-actuated brakes which upon hand squeezing of a bicycle type hand brake lever, a plurality of brake blocks contact the respective wheels to apply braking force to all but the rearmost wheel. U.S. Pat. No. 4,943,075 to Gates discloses wheeled skate-skis having hand actuated conventional bicycle-type caliper brakes with rubber pads to grip the rims of small air tires. The brakes can also be actuated during the rearward stroke each leg during simulated cross country skiing for propulsion to travel on the level and uphill.

While in-line skates provide forward and backward stability they can unduly limit a proficient skater's maneuverability and performance. In response thereto other types of skates have been designed such as mono-wheel skates wherein each of the skates has one large main wheel positioned below the middle of the skater's foot upon which the skater balances and is supported. The single large main wheel allows a proficient skater to move more quickly and with more agility due to the small contact area of the single main wheel of each skate with the ground. Other smaller wheels may be included in mono-wheel skates which wheels only contact the ground such as for braking. In U.S. Pat. No. 3,010,732 to Correll are disclosed mono-wheel skates which also include a small wheel rotatably mounted below the toe portion of the boot. Other mono-wheel skates are disclosed in U.S. Pat. No. 3,224,785 issued to Stevenson, in one embodiment of which each skate has a single very large main wheel located under the middle portion of the skater's foot, and includes an elaborate hydraulic or pneumatic braking system which attaches to each of the skater's legs which is actuated by flexing the skater's legs. A smaller brake wheel is pivotally mounted behind the main wheel on an arm which pivots toward the main wheel upon applying downward force to the brake wheel such that the oppositely travelling outer surfaces of each contact the other to provide braking force to both wheels.

Other mono-wheel roller skates include those in U.S. Pat. No. 5,106,110 issued to Williamson which discloses mono-wheel skates having bicycle-type caliper brakes. U.S. Pat. No. 4,108,451 issued to Scheck, Sr. which discloses mono-wheel skates having hand actuated disk brakes operated by a single bicycle-type hand brake lever mounted on a belt around the skater's waist, and U.S. Pat. No. 4,194,751 issued to Shinmura which discloses a pair of mono-wheeled devices, each having a short handlebar attached to a support frame thereof similar to walking stilts with the respective mono-wheels each having a drum-type brake which is operated by a hand actuator on the respective handlebar. A one-way clutch can also be used such that the mono-wheels can rotate only in the forward rotational direction.

Various types of suspension systems have been used on roller skates in an effort to provide a more pleasant ride for the skater. In U.S. Pat. No. 5,135,244 issued to Allison is disclosed two-wheeled in-line skates having a pair of respective short beams supporting a wheel at each end thereof. The beams are pivotally mounted intermediate the wheels to the ends of an elongate main beam which is pivotally mounted at the center thereof to a support frame affixed to a skate boot. A resilient means mounted thereto resists movement of the beams from horizontal for skater balance and stability. Also, the previously mentioned Soo Patent discloses a pair of short beams similar to those in Allison supporting a wheel at both ends thereof. Each short beam, however, is pivotally mounted intermediate the pairs of wheels directly to a support frame connected to a boot.

Other types of roller skates have been patented which have various distinctive features. For example U.S. Pat. No.

2,412,290 issued to O. G. Rieske discloses in-line roller skates having a plurality of wheels the outer surfaces of which are grooved to accept a continuous belt which extends around the wheels and which supported in the grooves in a similar manner to a tank tread. The purpose of the belt is to prevent scuffing of the floor surface. Another such distinctive feature is the use of toe protectors on roller skates. In U.S. Pat. No. 3,104,887 issued to Rice et al. is disclosed roller skates having a toe protector at the toe of the boot to prevent scuffing of the toe of the skate boot.

Various connection and disconnect mechanisms have been used on roller skates and ice skates to allow conversion of roller skates into ice skates and vice-versa. For example, U.S. Pat. No. 4,492,385 issued to Olson discloses skates each of which have a boot attached to a support frame having an elongate channel therethrough. An elongate beam supporting a plurality of wheels can be inserted into the channel and locked therein so as to comprise in-line roller skates. Likewise, an elongate ice skate blade can be used in place of the beam with wheels so as to comprise ice skates. The locking is provided for by a cam-lock which retains the ice blade and the beam with wheels in position. U.S. Pat. 5,193,827 issued to Olson discloses skates which have boots the bottom of each which have an attached front plate having a pair of downwardly dependent notched plates which engage protuberances at the top front of a support frame and an attached rear plate having a hole which is engaged by a rotary cam-lock on the support frame to releasibly hold the rear plate to the support frame. The various support frames include those for in-line roller skates and a separate support frame for ice skates. Other connection and disconnect mechanisms have been used on roller skates and ice skates such as in U.S. Pat. No. 4,932,675 issued to Olson et al. which discloses skates having boots the bottom of each of which has an attached front and rear plate both of which plates including spaced inwardly directed tongue portions which engage longitudinally extending front and rear grooved portions of in-line roller skate support frames and ice skate support frames. A rear bolt extends into the rear portion of the support frames and threads into the rear boot plates to retain the support frames to the boot plates. U.S. Pat. No. 4,657,265 issued to Ruth discloses skates which have boots with a wide I-beam plate attached to the bottom of each which removably attach to attach to roller skate support frames and ice skate support frames having complimentary channels which mate with the I-beam plates. A plurality of screws extend laterally through the channels against the I-beam to lock the channels to the I-beam.

Finally, German Patent DE4222326A1 discloses skates which have plastic boots and plastic support frames which accept both a plurality of wheels so as to comprise an in-line skate and which accept an ice skate blades. The plastic support frames attach to the plastic boots by means of an elongate angled key on the bottom of each boot which slidingly engages a matching keyway at the top of each support frame. The respective keys and keyways are locked in place by means of bolts extending upwardly through the support frame which thread into the bottom of the boot.

SUMMARY OF THE INVENTION

According to the invention, multi-functional roller skates, a first embodiment of which comprises mono-wheel skates having a boot connectable to a support frame thereof to which one large diameter main wheel is connected which supports the weight of skater. The main wheel is typically pivotally mounted to the support frame by means of a spring-loaded pivot arm, and includes a resilient tire, both of which absorb bumps and ruts in the surface of the ground particularly for off-road skating. The main wheel can include a treaded tire for off-road skating, a rail guard for sliding down stair rails, and a removable rock guard which works in conjunction with a built-in rail guard deflect and prevent debris from accumulating in front of the main wheel, also for off-road skating.

A brake mechanism comprising a brake actuation wheel having a resilient outer tire is pivotally mounted to the support frame behind the main wheel by means of a spring-loaded arm. A caliper brake, typically of the center-pull type, having scissored brake arms which grip the sides of the main wheel is interconnected with the brake actuation wheel. Tilting the skate rearwardly so as to contact the brake actuation wheel against the ground actuates the caliper brake against the sides of a main wheel to providing braking action thereto. The caliper brake and brake actuation arm typically has multiple adjustments to allow tuning of the brakes and changing of the position of the brake actuation wheel for individual skaters.

A toe push-off means comprising an arcuate toe push-off piece or a unidirectionally rotatable toe push-off wheel may be attached to the support frame adjacent the toe of the boot. The toe push-off piece is typically removably mounted and includes a curved front surface of a gripping material which extends from just above the toe of the boot downwardly around to below the ball of the foot and directed toward the lower edge of the main wheel tire. The toe push-off piece allows a skater to use an in-line skating stroke wherein the skates remain pointed in the direction of travel rather than the conventional outwardly angled stroke usually used for skating. The toe push-off wheel serves the same function as the toe push-off piece by rotating freely only in the forward rotational such that a skater can push-off from the toe push-off wheel, such as by means of a ratchet mechanism thereof.

The boot can be removably attachable to the support frame such as by means of a quick-release mechanism wherein other support frames with different configurations of wheels or having ice skate blades can be quickly interchanged therewith without necessitating the skater to change boots. Each boot can be removably attachable such as by means of a horizontal plate affixed thereto having a pair of downwardly dependent longitudinally extending locking keys which extend into a pair of clearance slots in an upper portion of the support frame, which longitudinally slide into a pair of mating locking slots also in the upper portion of the support frame. The keys have angled surfaces which provide improved locking in multiple planes and are short so as to quickly and easily attach to the support frame. A laterally insertable spring pin retains the keys from sliding out of the respective locking slots.

A second embodiment multi-functional roller skate includes an in-line roller skate support frame of similar construction to and in place of the mono-wheel support frame, being interchangeable therewith, and which includes a plurality of smaller wheels typically all being of the same diameter. A drag-type brake pad may be positioned behind the rearmost wheel and the skate used like a conventional in-line skate utilizing a sideways stroke and dragging the brake pad to slow and stop. In a modified version thereof, one of the wheels, typically the frontmost wheel, is a unidirectionally rotating toe push-off wheel of the type described for the mono-wheel skate, such that the in-line skating stroke can be used wherein the skates remain pointed in the direction of travel rather than angled outward thereto as is usually required for skating. The rearmost wheel can also be mounted on a spring-loaded arm and a caliper brake having scissored brake arms which grip the sides of the second rearmost wheel can be interconnected therewith. This caliper brake operates in the same manner as for the mono-wheel skates such that tilting the skate rearward so as push the brake actuation wheel against the ground actuates the caliper brakes against the sides of a second rearmost wheel or other wheel desired so as to provide braking action thereto.

A third embodiment multi-functional roller skate comprising an off-road version of the in-line skate uses the same support frame as the in-line skate but with smaller, modified tireless wheels and a continuous tank-tread type belt. The belt typically extend about half-way around the endmost wheels, atop and below the middle wheels, with the wheels including hubs, the outer periphery of which interact with the belt to maintain the belt in a centered position on the respective hubs. The belt typically has road gripping lateral ribs or grooves on the exterior surface thereof. The belt acts to even out bumps and ruts by spanning between adjacent wheels and aids in preventing debris from jamming in front of the wheels. A unidirectional toe push-off type wheel may be included in place of any of the wheels such that the in-line skating stroke can be used which stroke aids in maintaining the belt centered on the respective wheels by not introducing the substantial side loads induced by a conventional side push-off skating stroke. Such toe push-off type wheel need not be the frontmost wheel since all of the wheels are interconnected by the belt so as to roll together. A caliper brake can be utilized as in the in-line skate wherein the rearmost wheel is pivotally mounted to the support frame, which actuates a caliper brake to clamp the sides of one of the other wheels to slow or stop the tread. One or more additional rollers or wheels may be positioned above the belt to aid in maintaining the belt in contact with the wheels during pivoting of the rearmost wheel during upward pivotal motion thereof during brake actuation. Mating laterally extending ribs or grooves may be formed in the inner face of the belt and on the outer surface of the wheels so as to more effectively transmit the braking force from the braked wheel to the belt.

A fourth embodiment multi-functional roller skate includes an ice skate support frame in place of the mono-wheel support frame, being interchangeable therewith. The ice skate support frame is of similar design to the in-line skate support frame, but having a narrower lower portion adapted to hold an elongate ice skate blade rather than wheels, by means of a plurality of laterally extending screws which clamp the blade in place.

THE DRAWINGS

Figure 2:
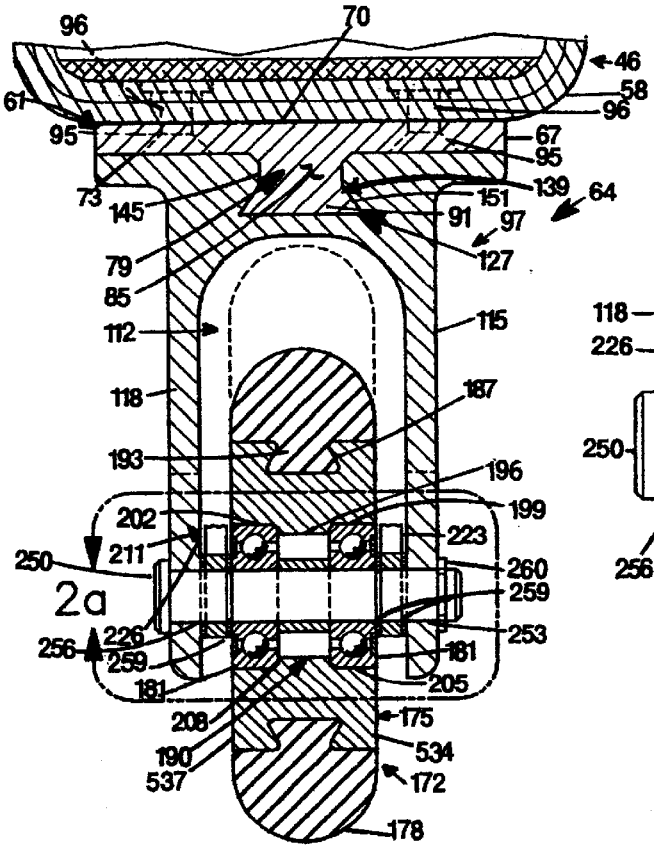
Figure 2A:
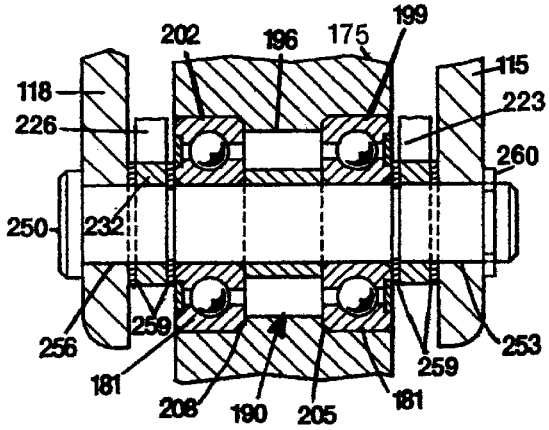
Figure 3A:
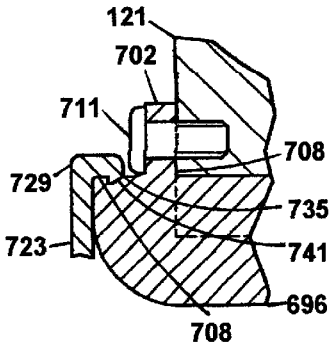
Figure 3:
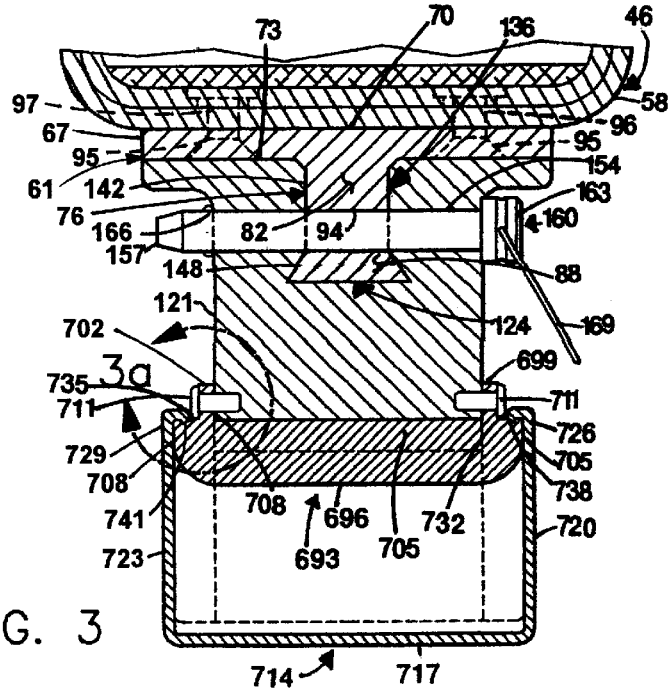
Figure 4:
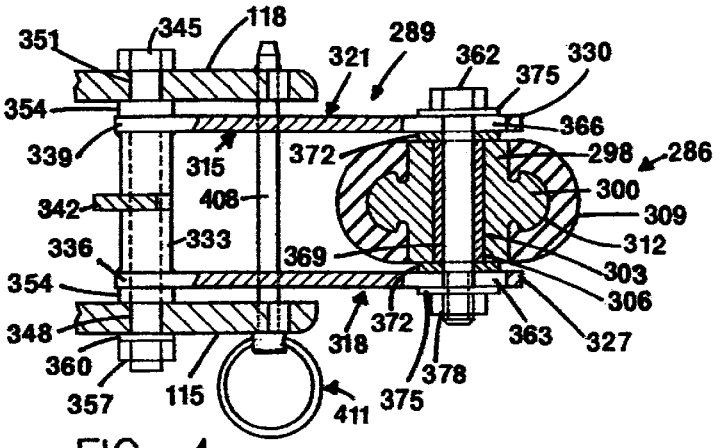
Figure 20:
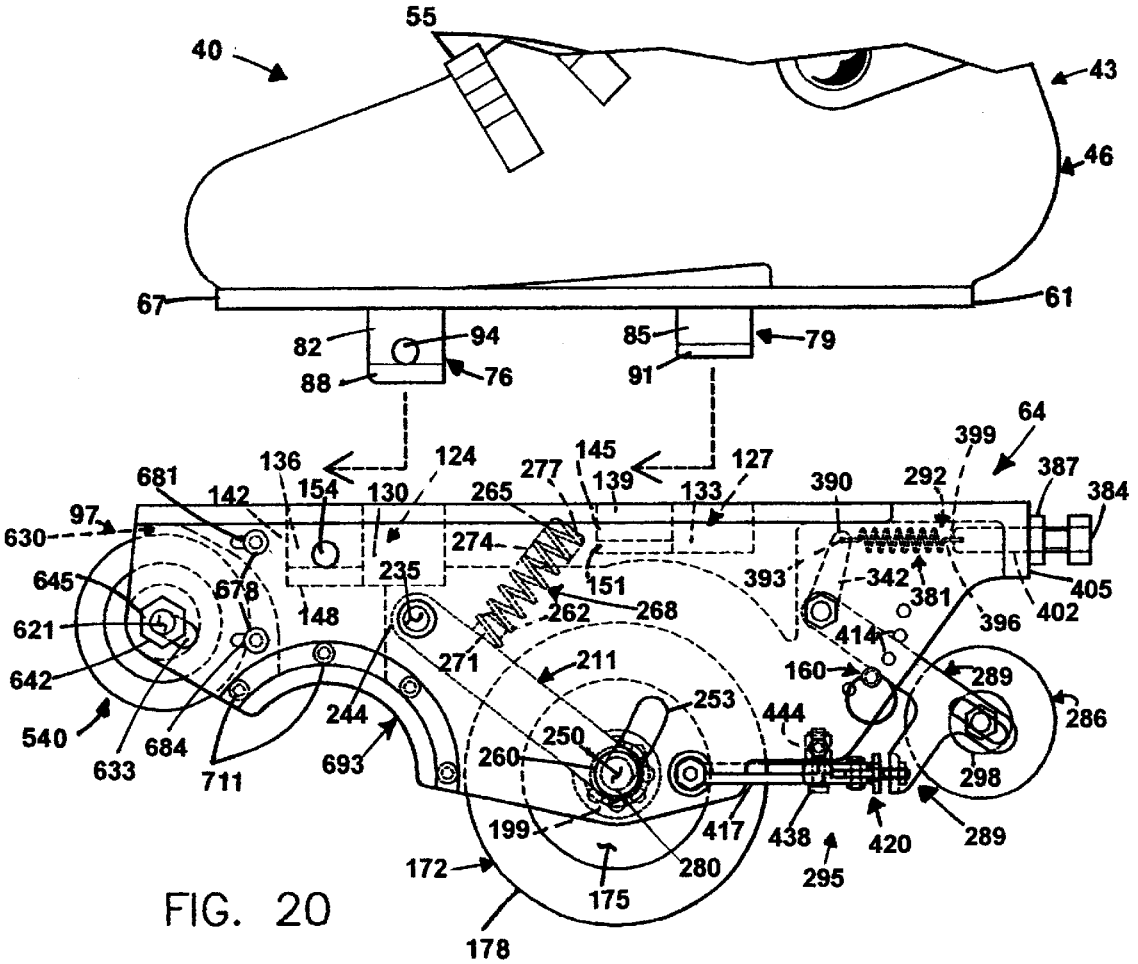
Figure 5A:
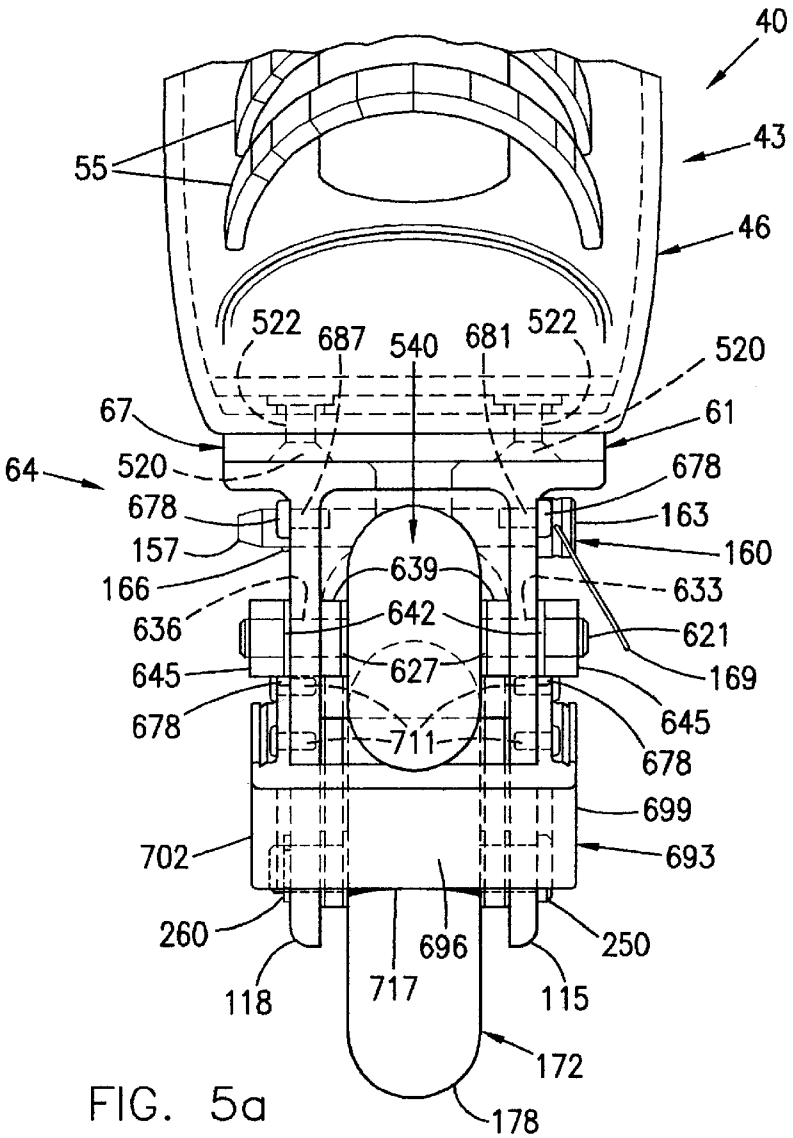
Figure 5:
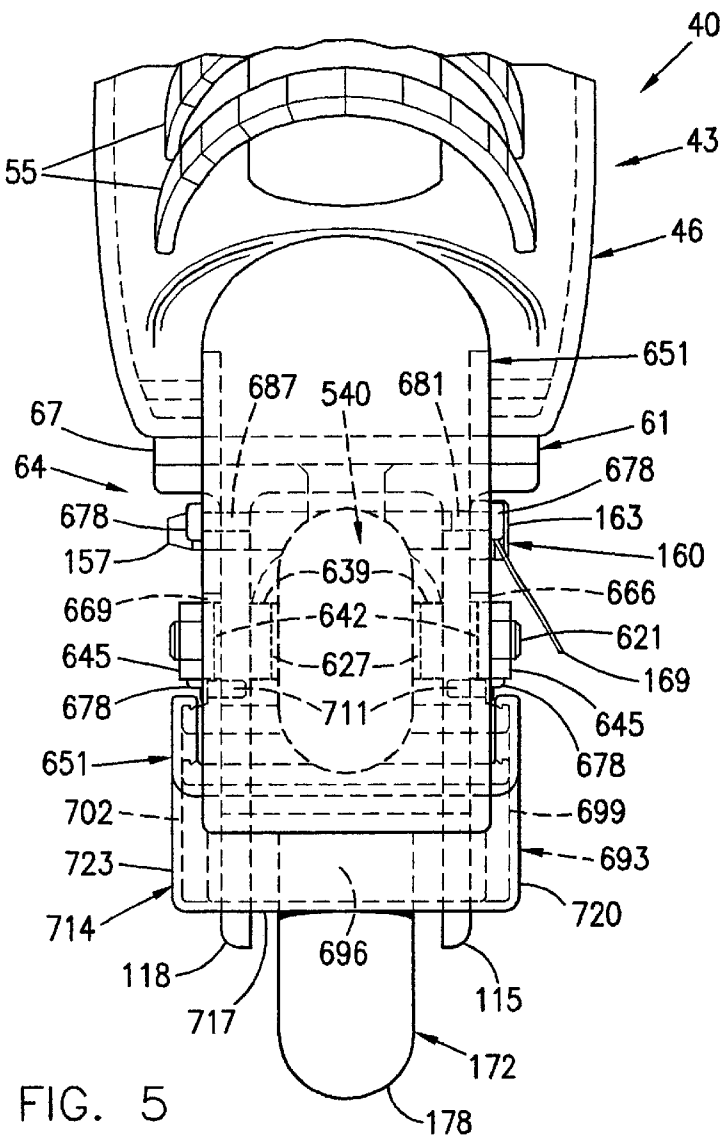
Figure 6:
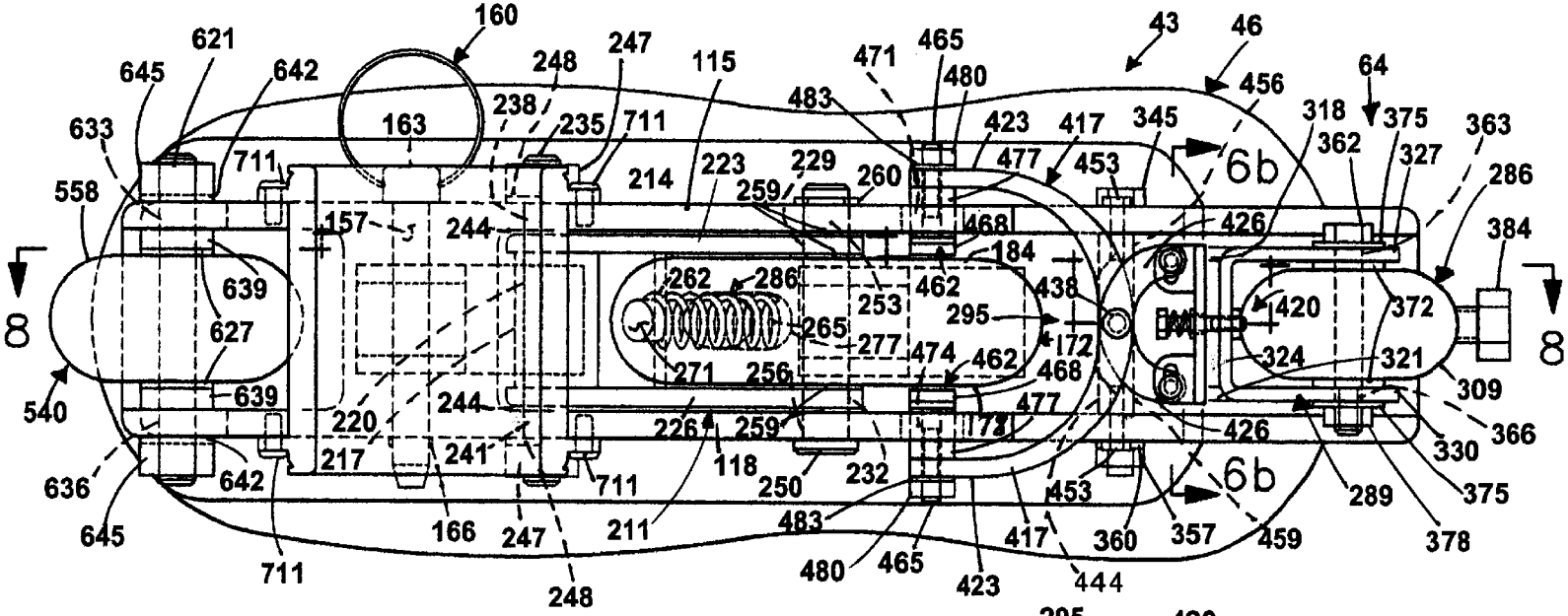
Figure 6A:
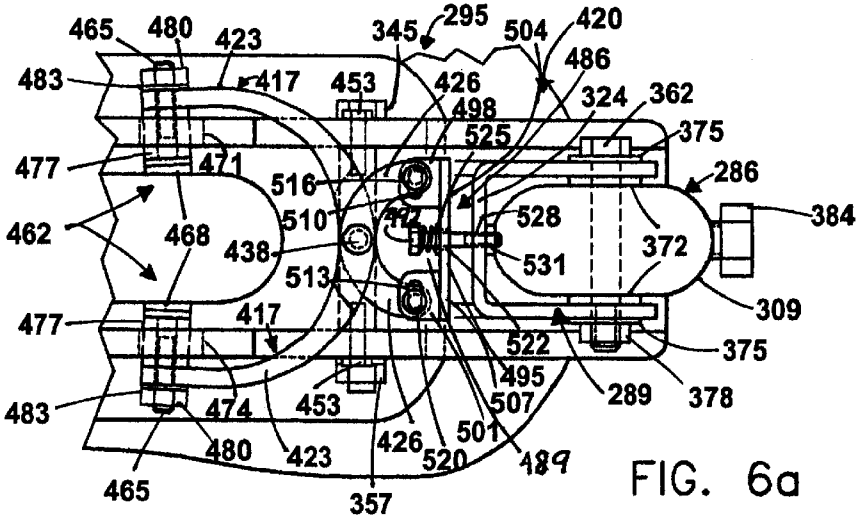
Figure 6B:
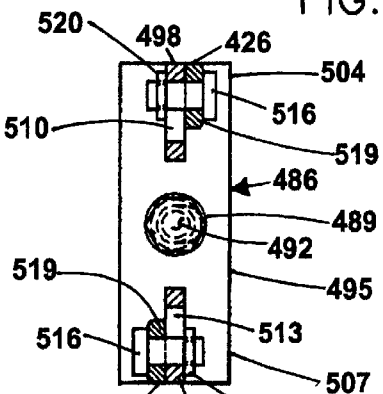
Figure 9:
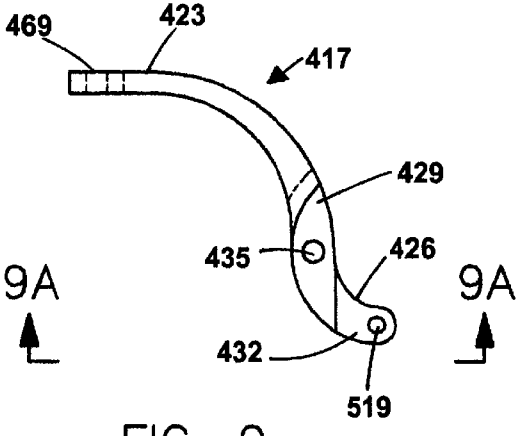
Figure 9A:
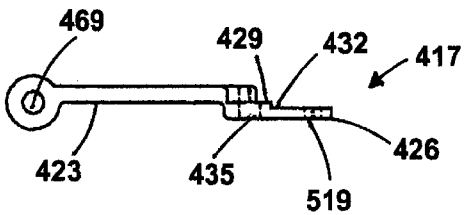
Figure 7:
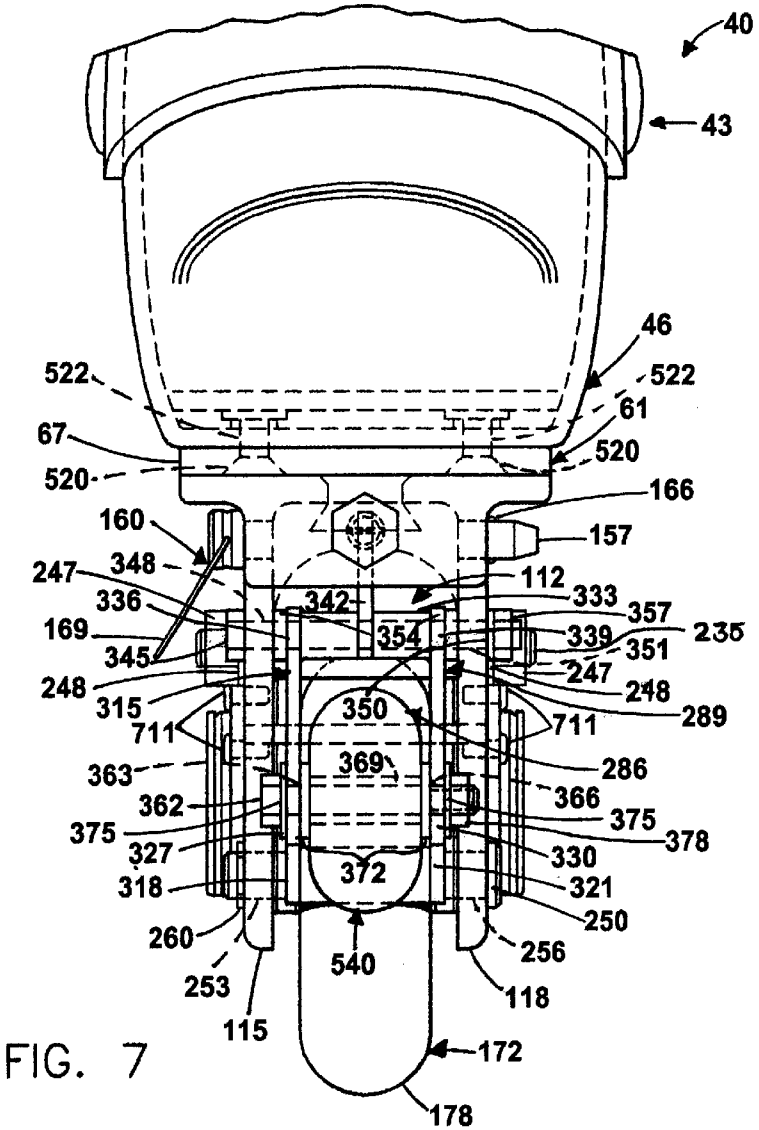
Figures 8, 8A:
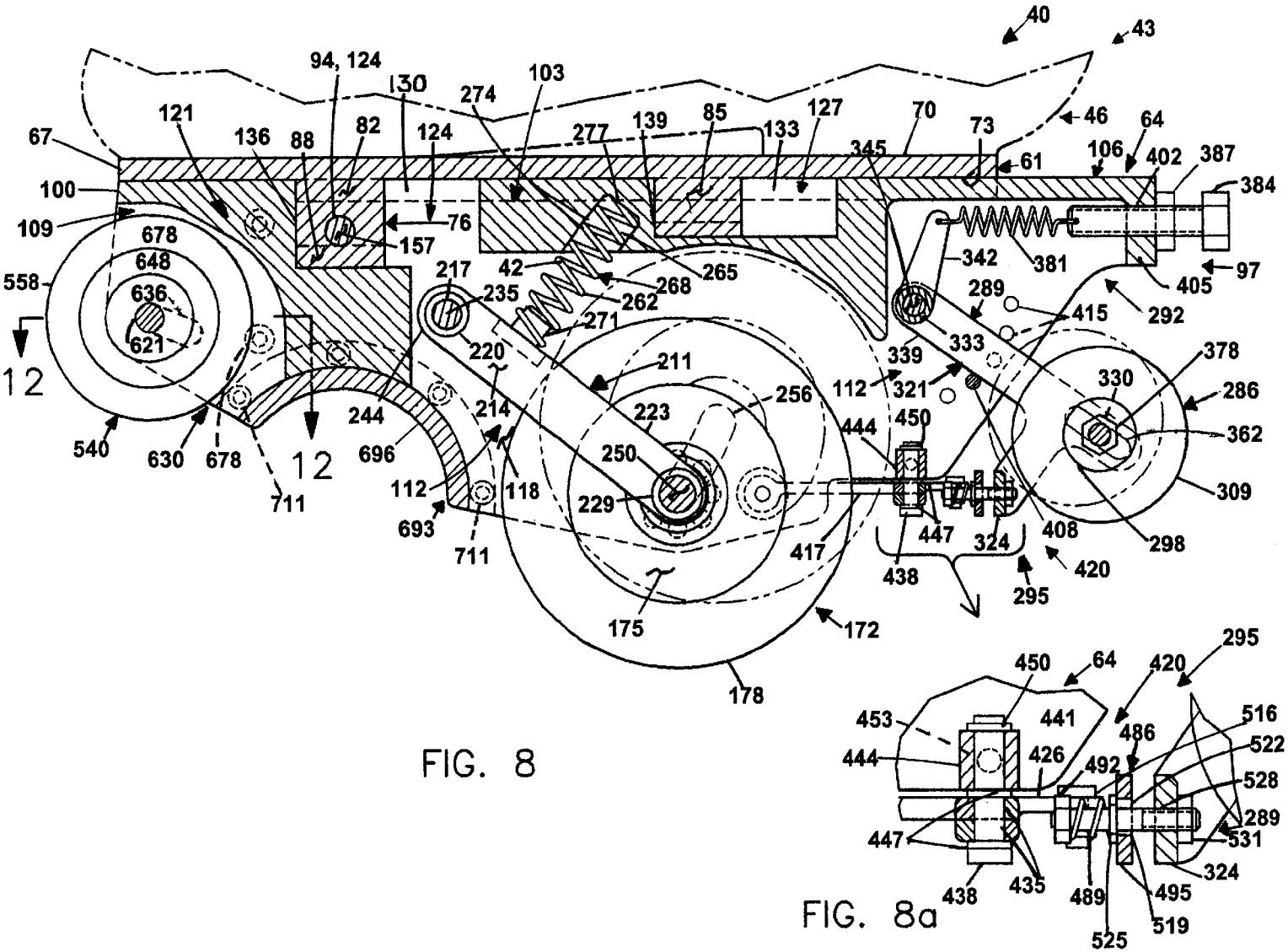
Figure 10:
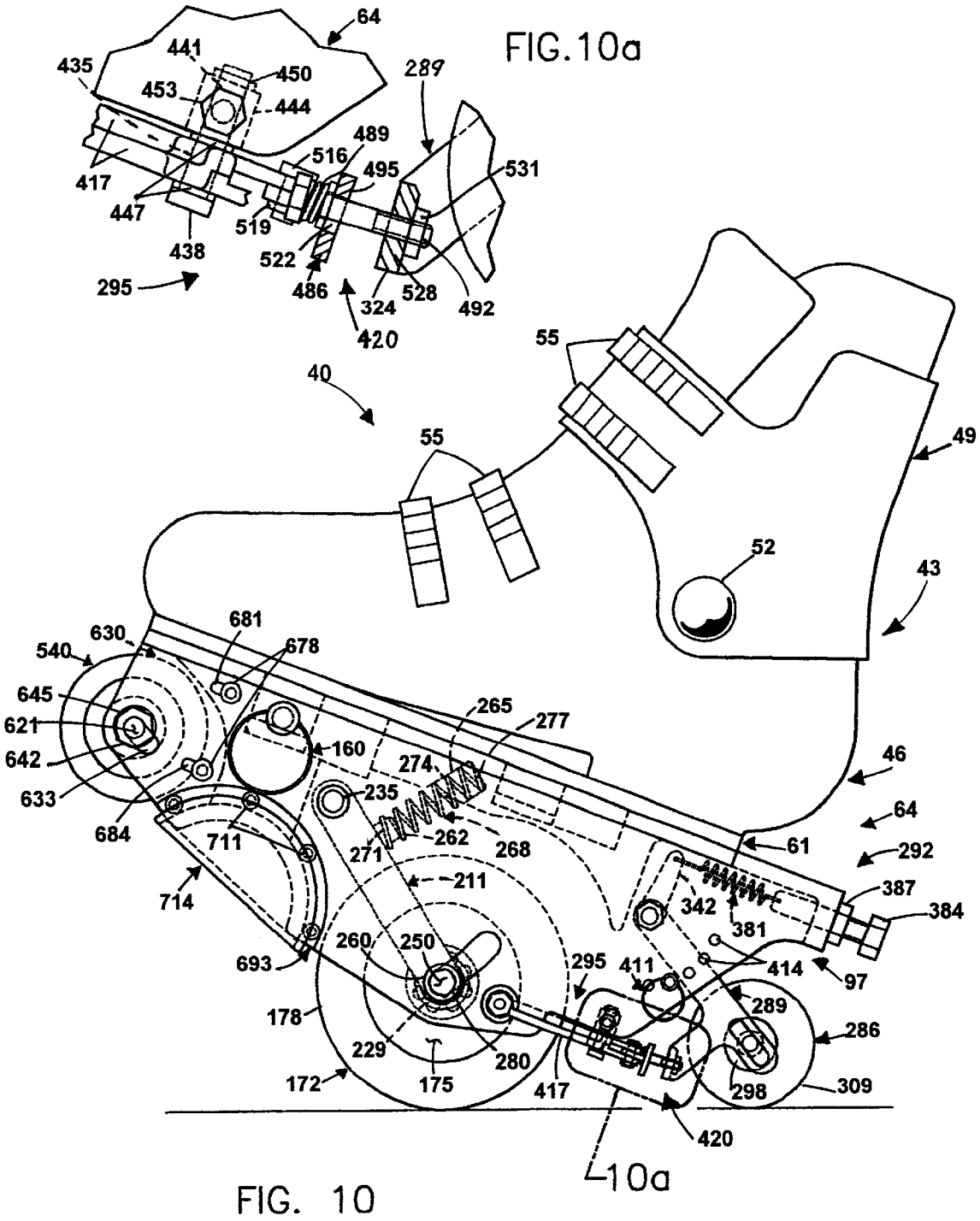
Figure 11:
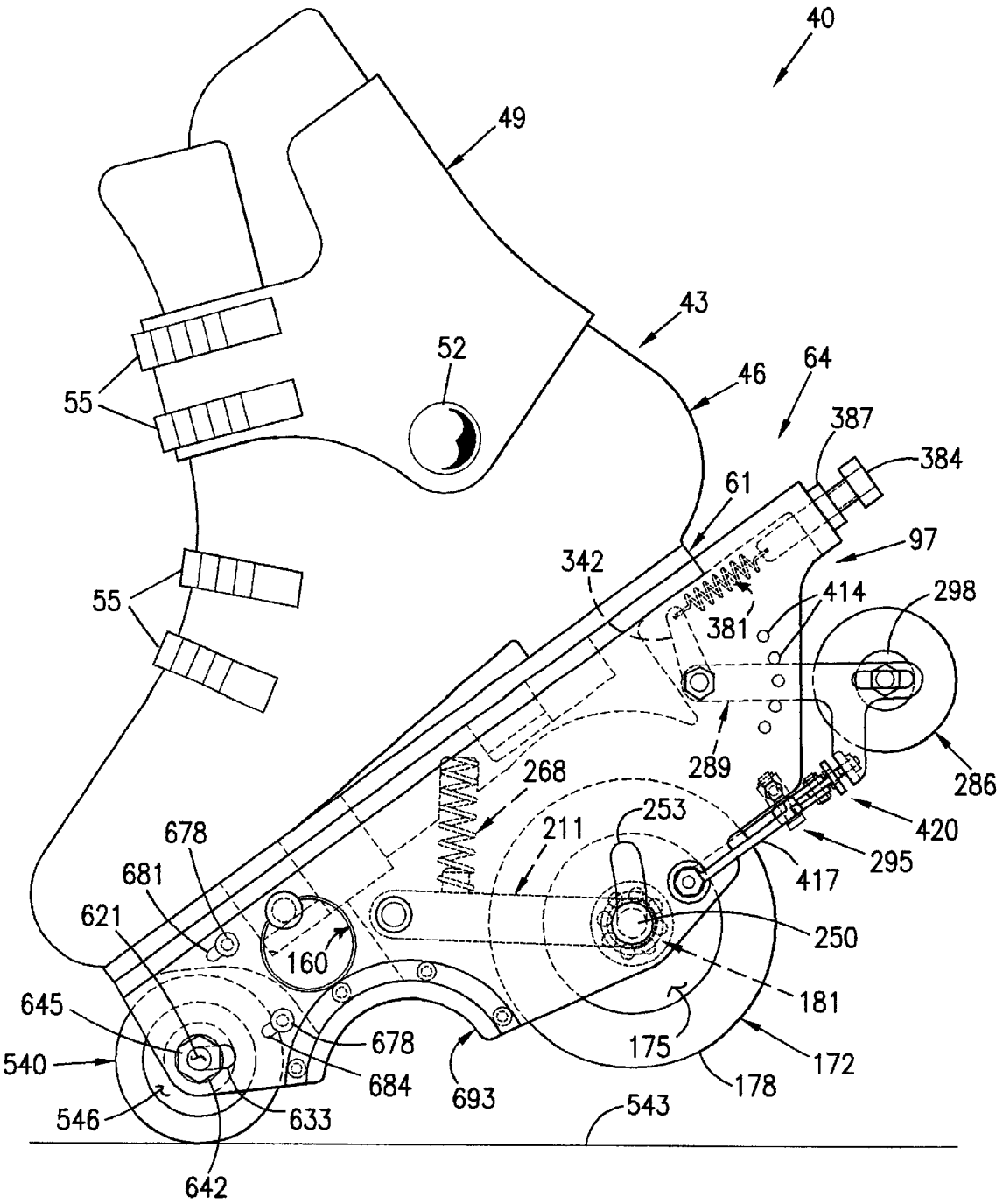
Figure 12:
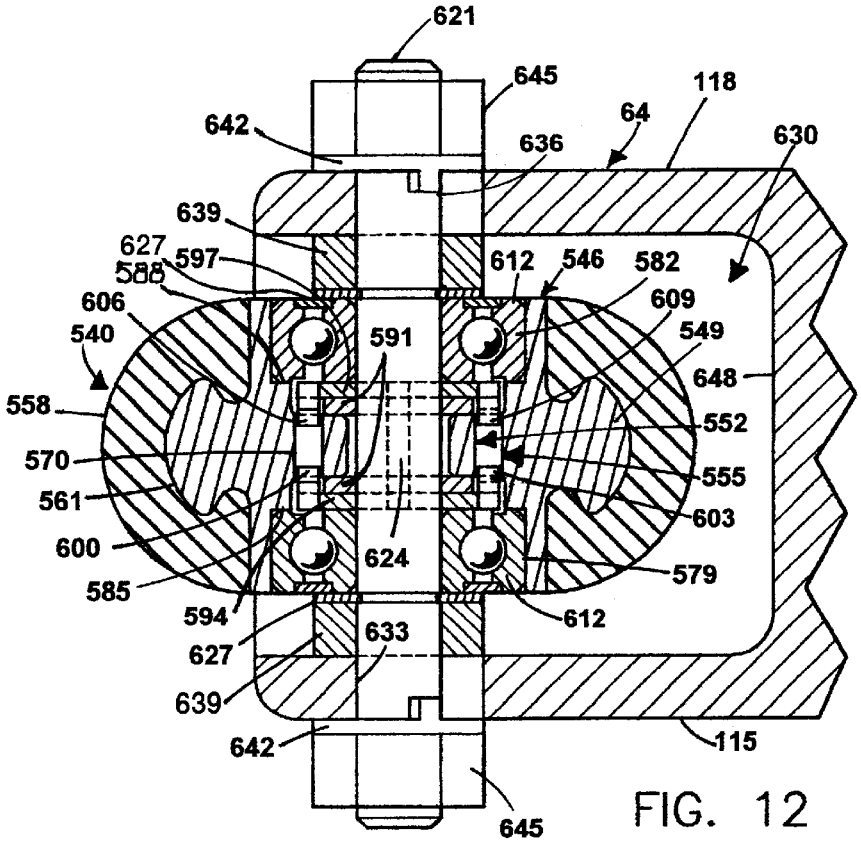
Figure 13:
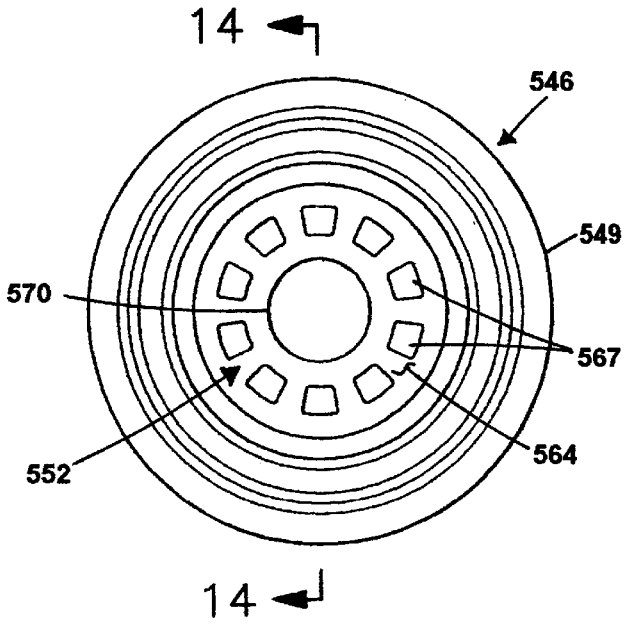
Figure 14:
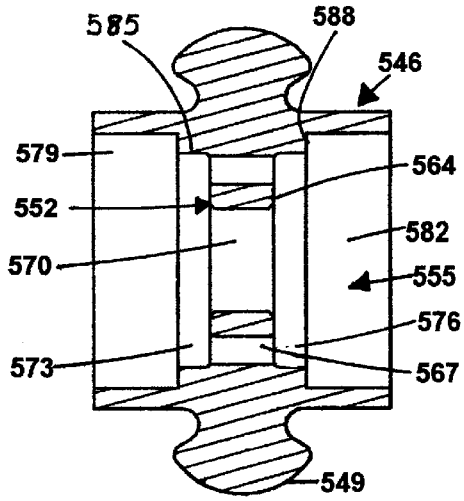
Figure 17:
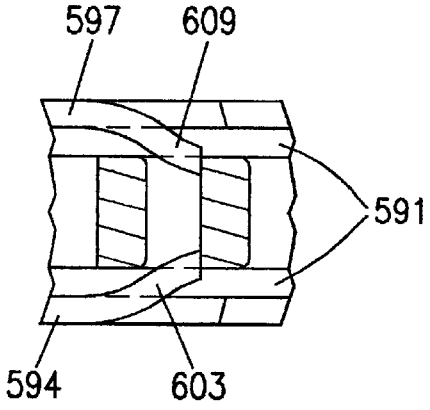
Figure 18:
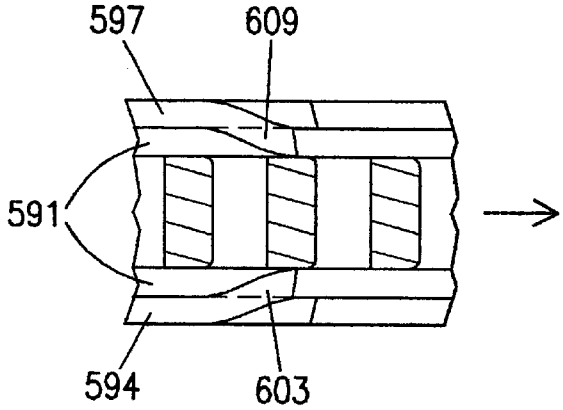
Figure 15:
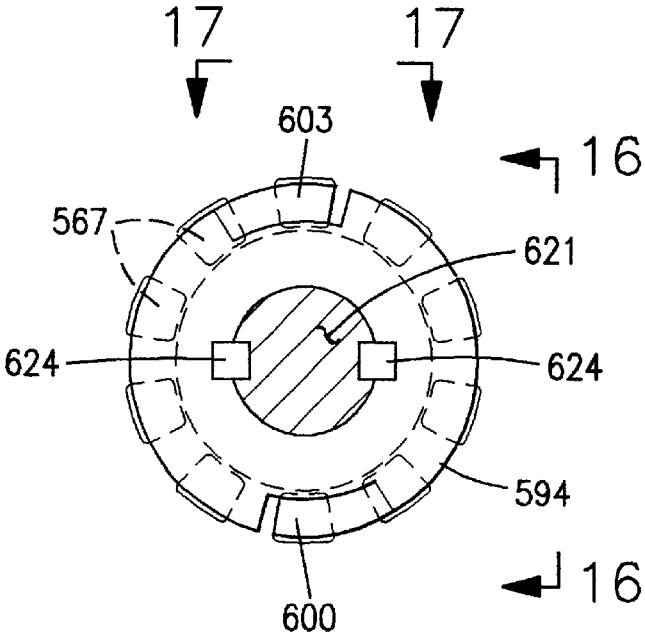
Figure 16:
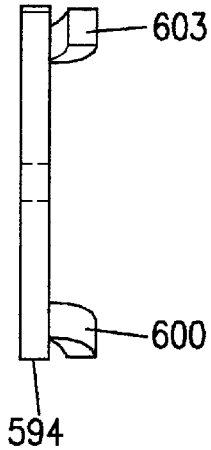
Figure 19:
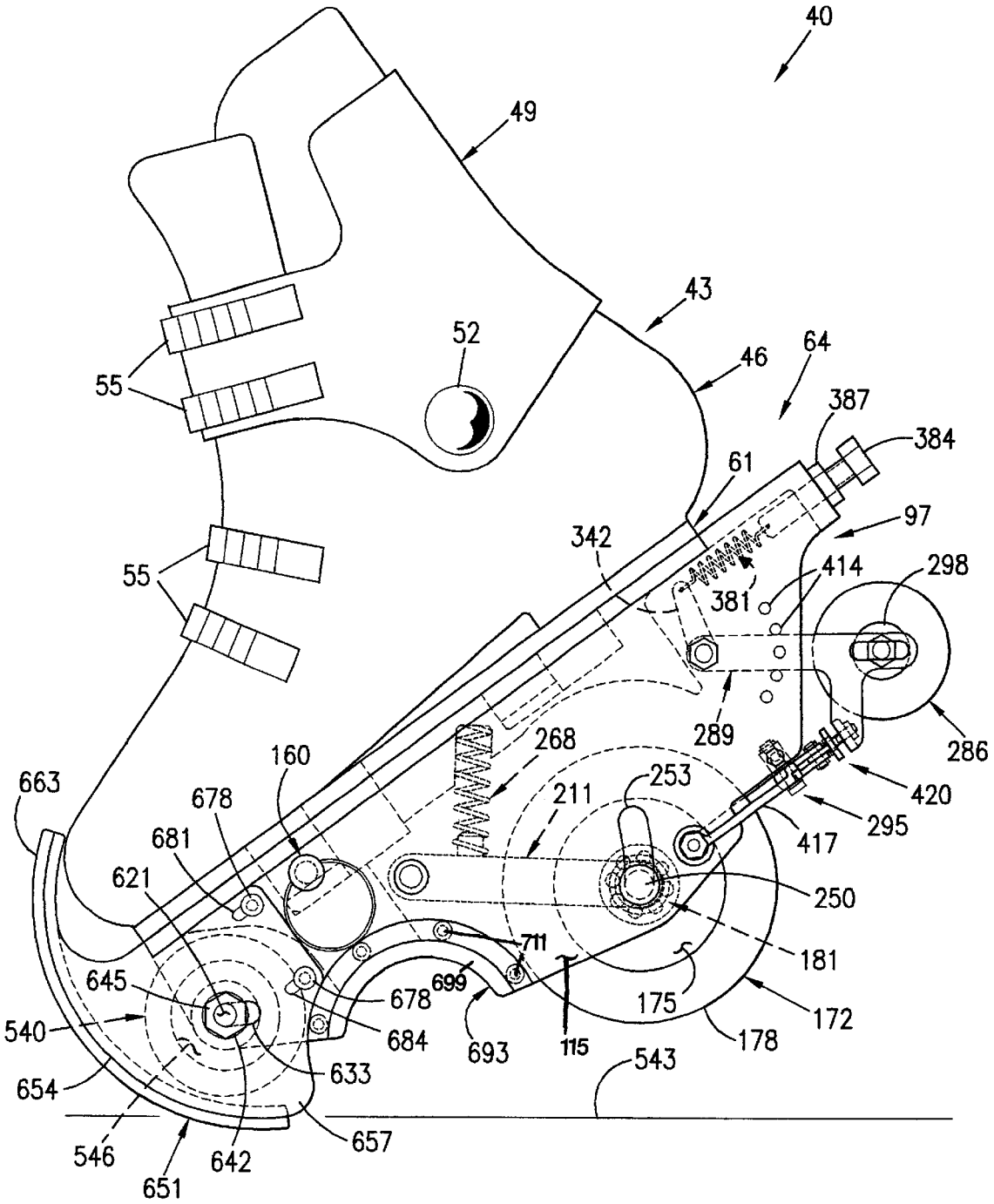
Figure 21:
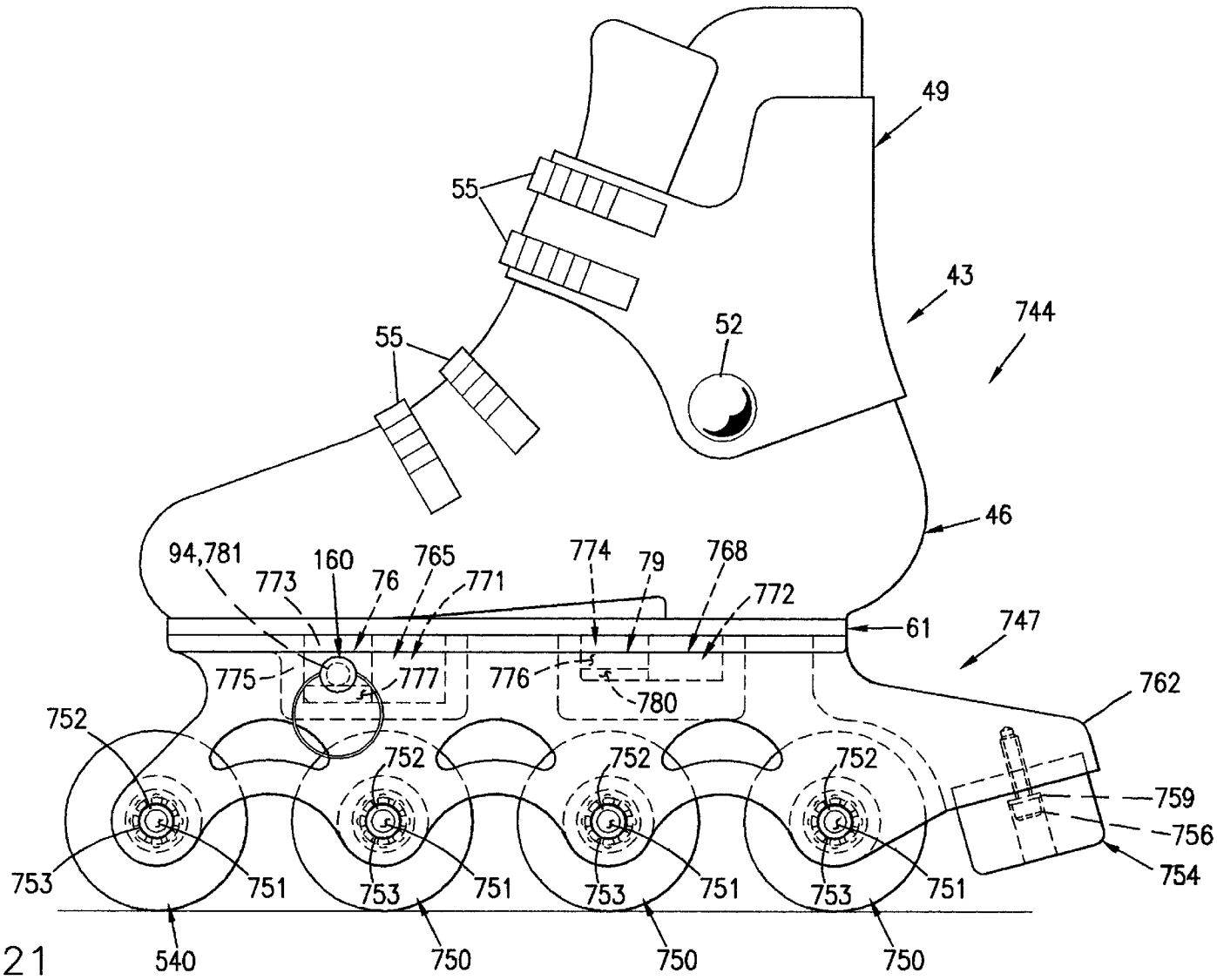
Figure 22:
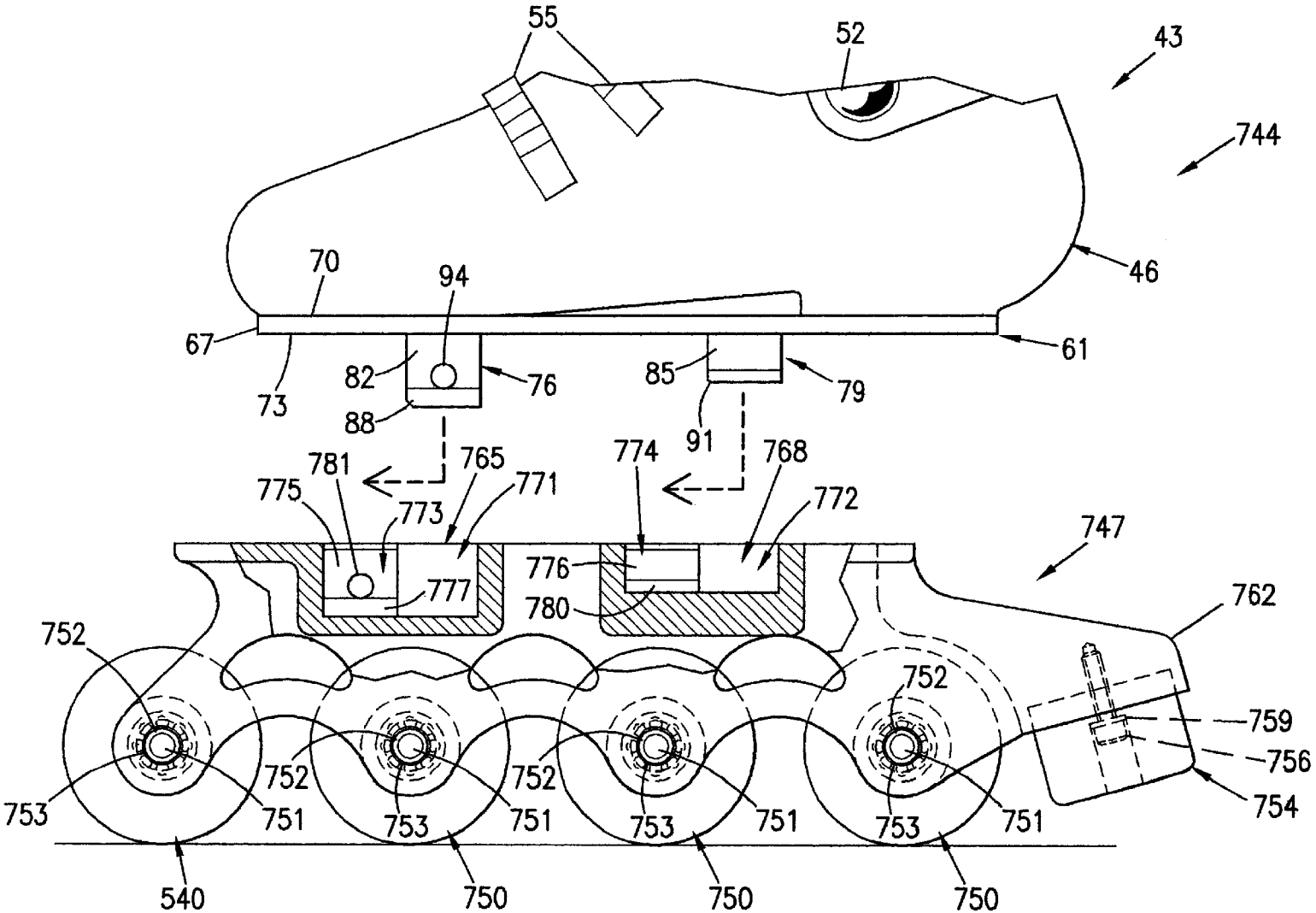
Figures 23, 24:
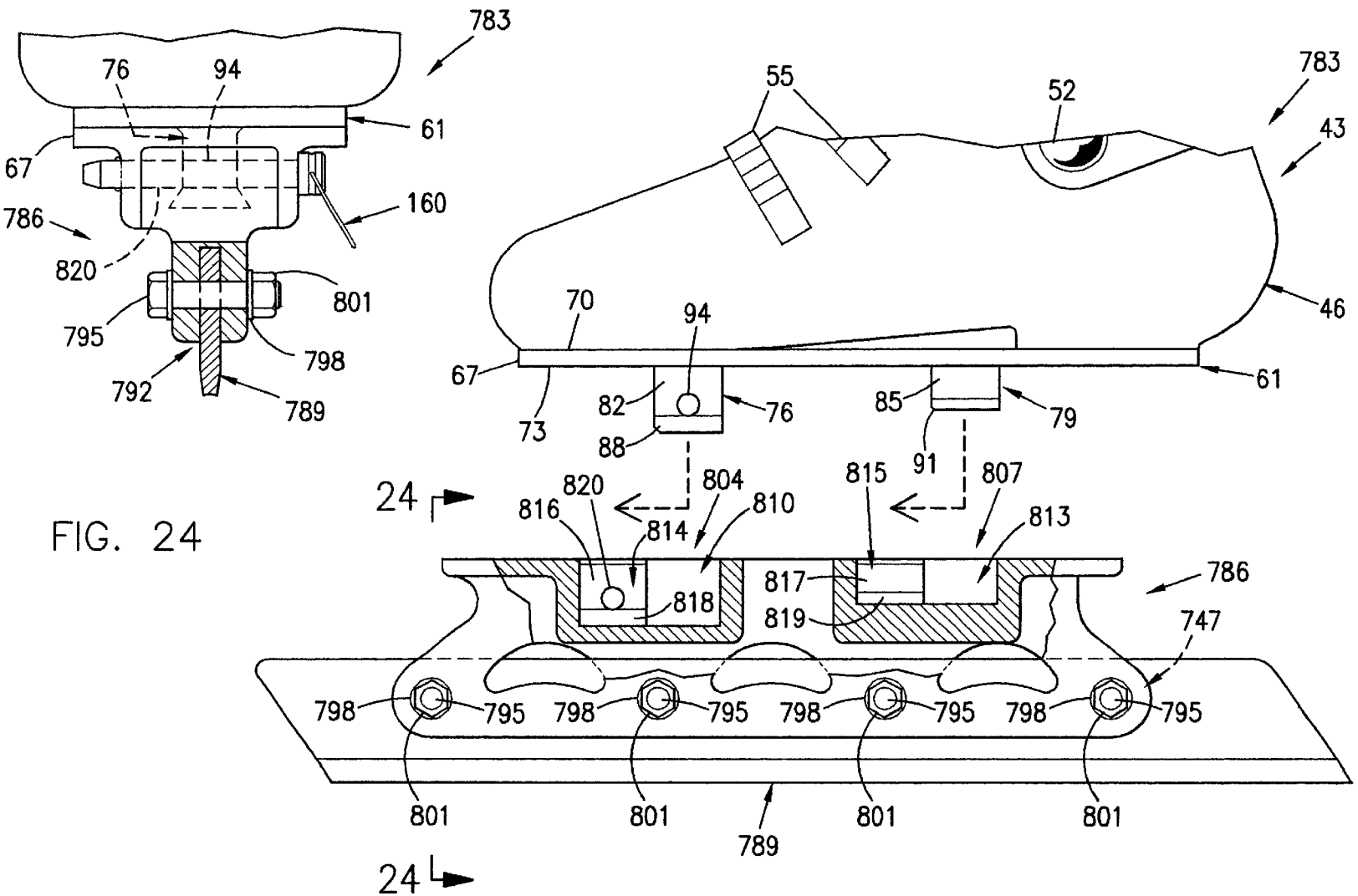
Figures 25, 26:
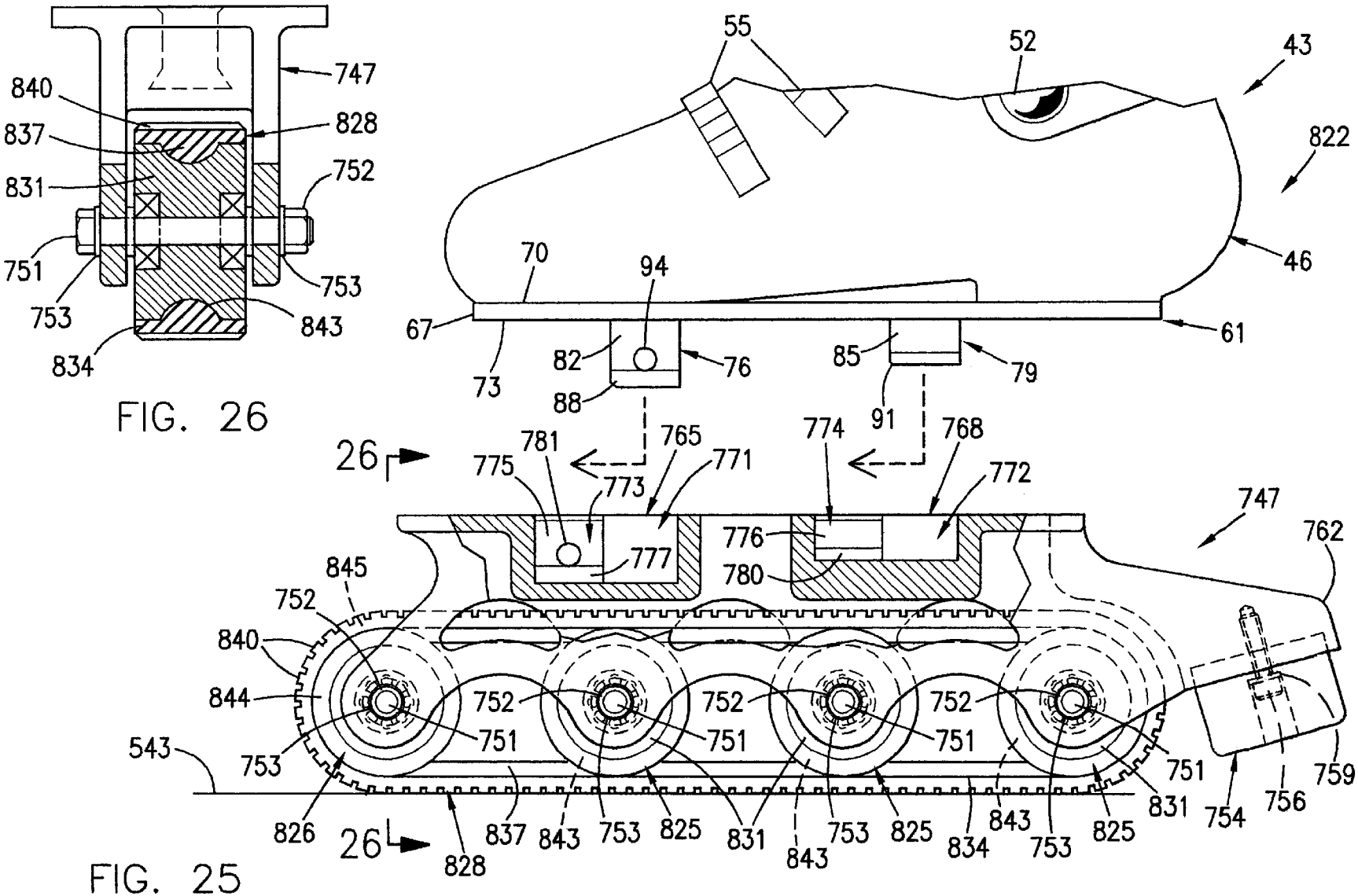
Figure 27:
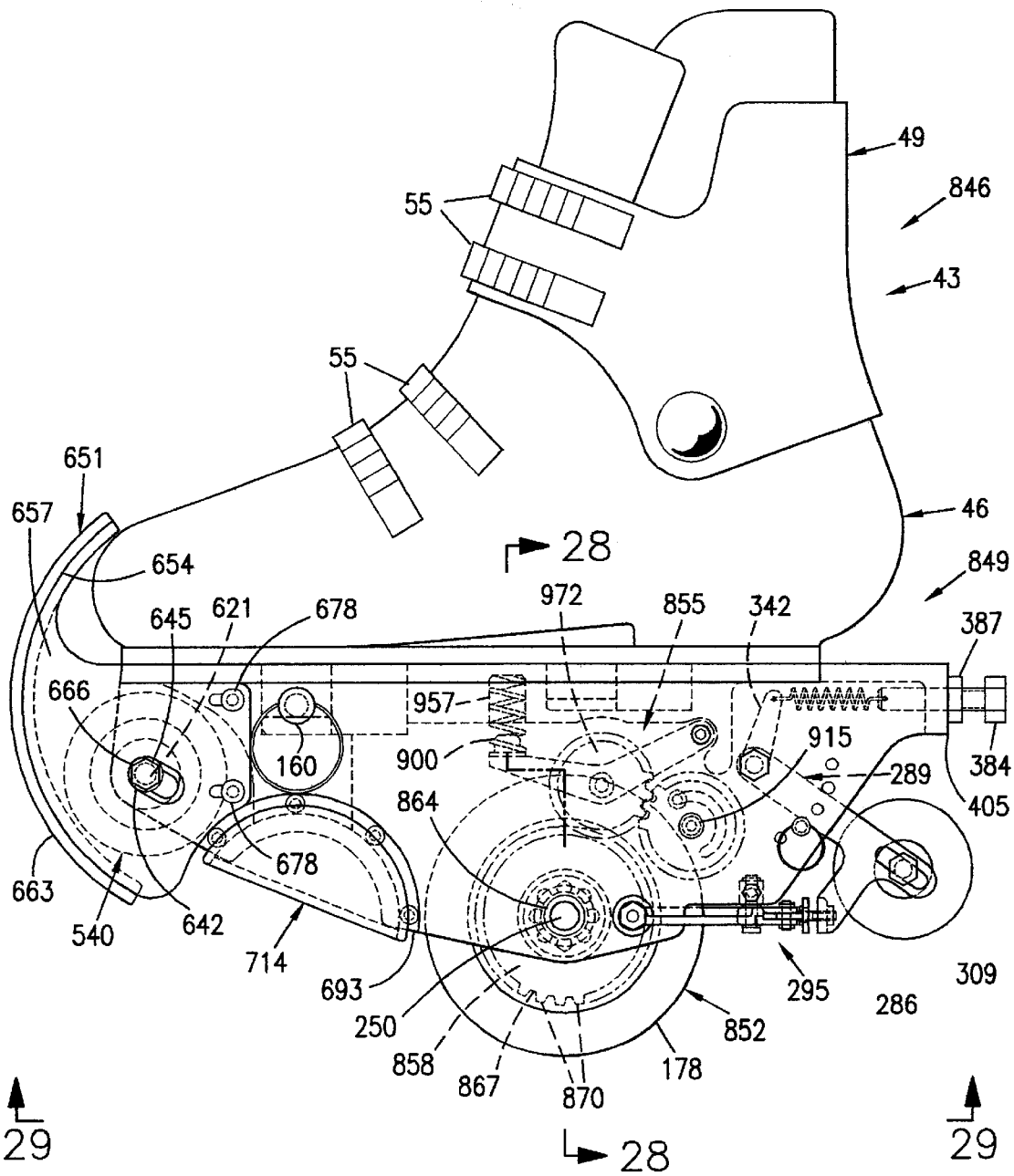
Figure 28:
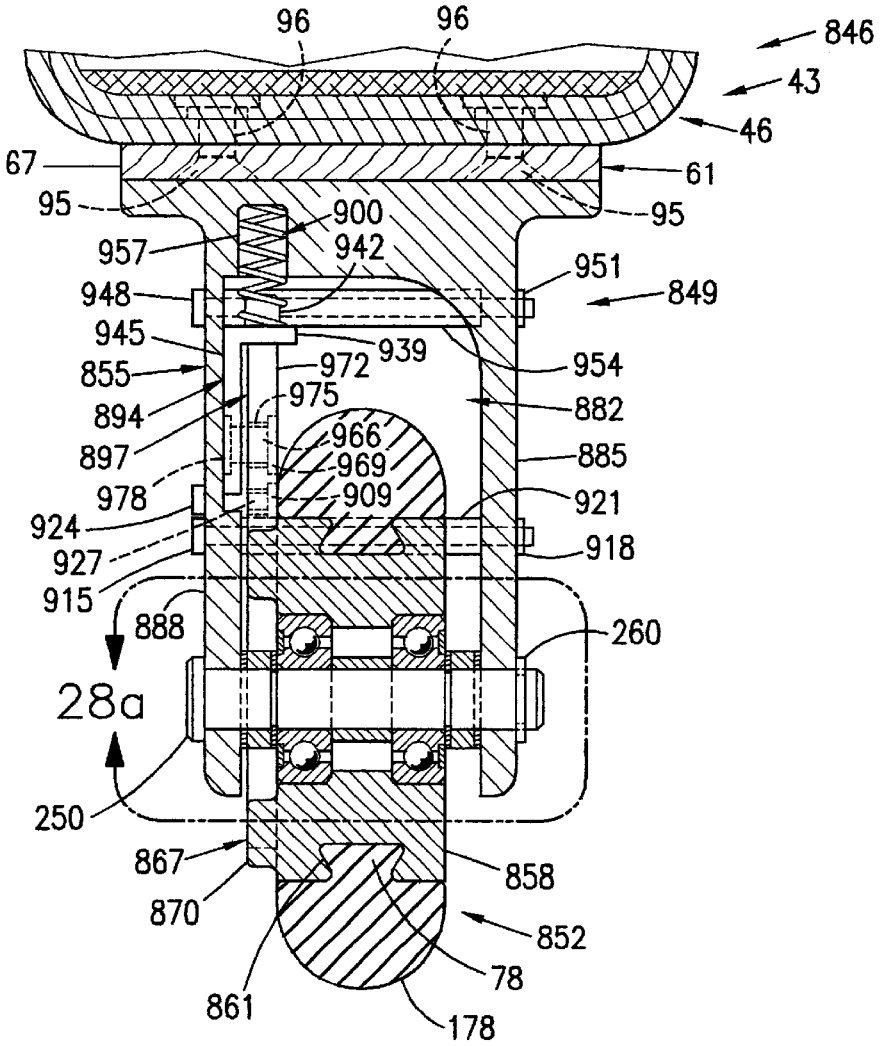
Figure 28A:
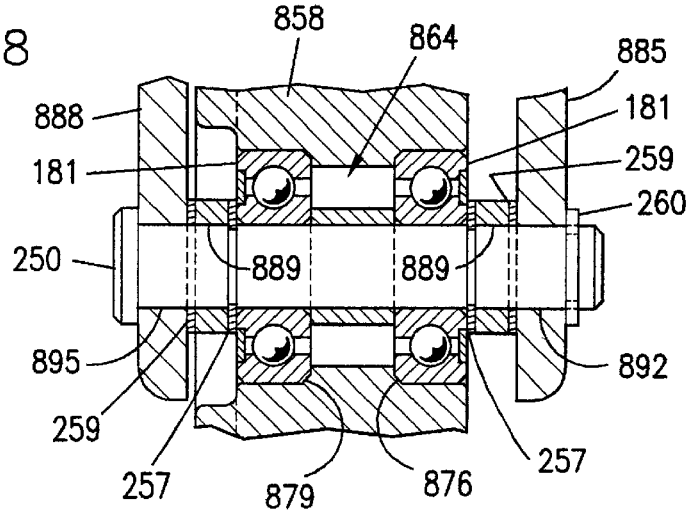
Figure 29:
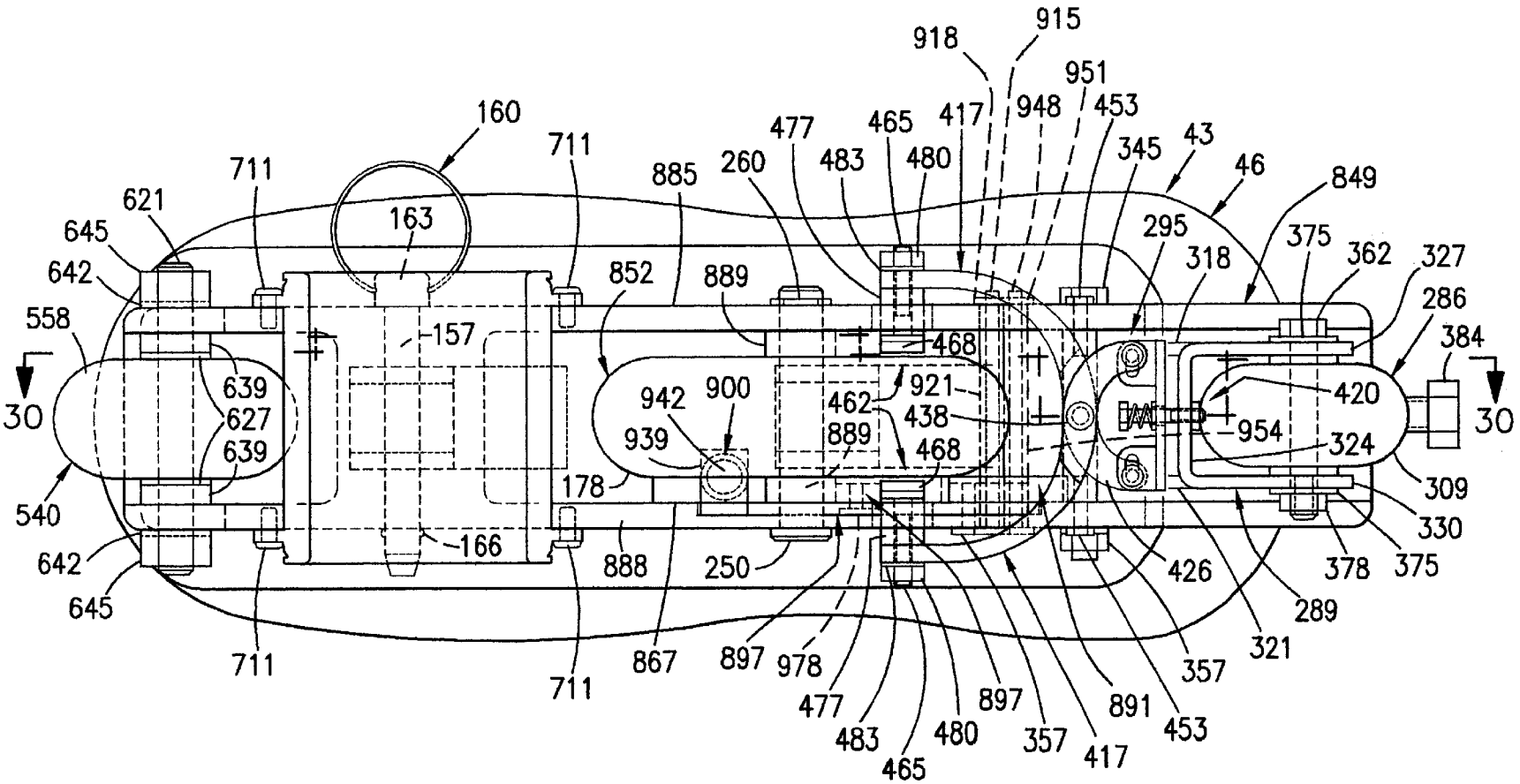
Figure 30:
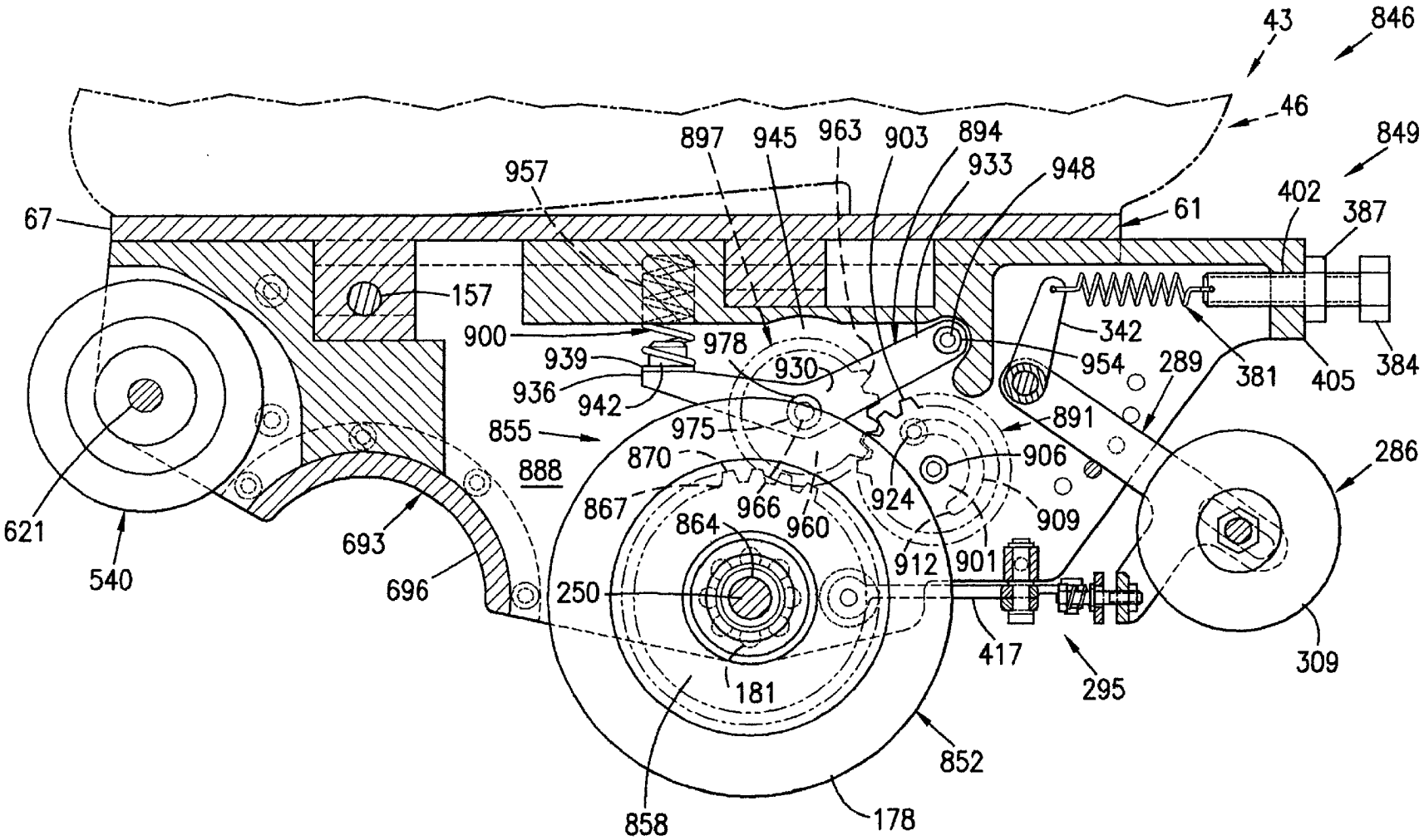

The best mode presently contemplated for carrying out the invention is illustrated in the accompanying drawings, in which:

FIG. 1 is a side elevational view of a first embodiment skate of the invention comprising a mono-wheel skate having a swing-arm-suspension-mounted main wheel;

FIG. 2, an enlarged fragmentary view in lateral vertical section taken on the line 2—2 of FIG. 1 showing the support frame, main wheel, and pivot arm;

FIG. 2A, an enlarged fragmentary view taken on the line 2*a*—2*a* of FIG. 2 showing the details of the support frame, main wheel, and pivot arm;

FIG. 3, an enlarged fragmentary view in lateral vertical section taken on the line 3—3 of FIG. 1 showing the details of the rail guard, the rock guard, the keyed boot plate and support frame, and the release pin;

FIG. 3A, an enlarged fragmentary view in lateral vertical section view taken on the line 3*a*—3*a* of FIG. 3 showing the details of the connection of the support frame, rail guard, and rock guard;

FIG. 4, an enlarged fragmentary section view taken on the line 4—4 of FIG. 1 showing the support frame, pivot arm, and brake actuation wheel;

FIG. 5, a fragmentary front elevational view taken on the line 5—5 of FIG. 1 showing the toe push-off piece installed;

FIG. 5A, a fragmentary front elevational view corresponding to FIG. 5 with the toe push-off piece removed showing the toe push-off wheel;

FIG. 6, a bottom plan view taken on the line 6—6 of FIG. 1 showing the mounting of the wheels to the support frame;

FIG. 6A, a fragmentary view corresponding to FIG. 6 showing the brake actuation wheel and caliper brake with linkage;

FIG. 6B, a fragmentary view in lateral vertical section taken on the line 6*b*—6*b* of FIG. 6 showing the pivotal connections of the brake arms to the T-beam;

FIG. 7, a fragmentary rear elevational view taken on the line 7—7 of FIG. 1 showing the mounting of the brake actuation wheel to the support frame;

FIG. 8, a fragmentary view in longitudinal vertical section taken on the line 8—8 of FIG. 6 showing the details of the support frame and the mounting of the wheels to the support frame within the cutout chambers of the support frame;

FIG. 8A, an enlarged fragmentary view taken from FIG. 8 showing the details of the caliper brake with linkage;

FIG. 9, an enlarged top plan view of a brake arm;

FIG. 9A, a side elevational view of the brake arm taken on the line 9A—9A of FIG. 9;

FIG. 10, a side elevational view of the roller skate of the invention in the braking position wherein the brake actuation wheel contacts the ground;

FIG. 10A, an enlarged fragmentary view taken on the line 10*a*—10*a* of FIG. 10 showing the caliper brake with linkage in the actuated position;

FIG. 11, a side elevational view of the roller skate of the invention in the toe push-off position wherein the locking toe push-off wheel contacts the ground for thrusting the skater forward;

FIG. 12, a fragmentary lateral horizontal section taken on the line 12—12 of FIG. 8 showing the details of the locking toe push-off wheel;

FIG. 13, a view of the wheel hub alone of FIG. 12;

FIG. 14, a view in lateral vertical section taken on the line 14—14 of FIG. 13 showing the details of the wheel hub;

FIG. 15, a view showing the ratchet plates and their relationship to the flat disk portion of the wheel hub;

FIG. 16, a rear elevational view taken on the line 16—16 of FIG. 15 showing a ratchet plate with locking tabs;

FIG. 17, an enlarged fragmentary top plan view taken on the line 17—17 of FIG. 15 showing the locking tabs locking against the faces of the radial holes of the flat disk portion of the wheel hub;

FIG. 18, an enlarged fragmentary view corresponding to FIG. 17 showing the wheel hub rotating in the reverse or freewheeling direction wherein the locking tabs of the ratchet plates do not engage the faces of the radial holes;

FIG. 19, a side elevational view of the roller skate of the invention in the push-off position with the arcuate push-off piece positioned over the toe push-off wheel locking wheel and contacting the ground for thrusting the skater forward;

FIG. 20, a side elevational view of the invention showing quick connect and disconnect of the boot to the support frame;

FIG. 21, a side elevational view of a second embodiment skate of the invention, an in-line skate, having a support frame which supports a plurality of in-line wheels and having a rear brake pad;

FIG. 22, a side elevational view of such in-line skate showing the quick connect and disconnect of the boot to the support frame;

FIG. 23, a side elevational view of a third embodiment skate of the skate of the invention, an ice skate, having a support frame which supports an ice skate blade and showing the quick connect and disconnect of the boot to the support frame;

FIG. 24, a lateral vertical section taken on the line 24—24 of FIG. 23 showing the details of the attachment of the blade of the ice skate to the support frame thereof;

FIG. 25, a side elevational view of a fourth embodiment skate of the invention, a tank tread skate, which utilizes the support frame of the in-line skate with a continuous belt running on modified tireless wheels and showing the quick connect and disconnect of the boot to the support frame;

FIG. 26, a lateral vertical section taken on the line 26—26 of FIG. 25 showing the details of the continuous belt, wheels, and support frame;

FIG. 27, a side elevational view of a fifth embodiment skate of the invention, a mono-wheel skate having a locking, single rotational direction, suspensionless main wheel;

FIG. 28, an enlarged fragmentary view in lateral vertical section taken on the line 28—28 of FIG. 27 showing the support frame, main wheel, and the single rotational direction locking mechanism;

FIG. 28*a*, an enlarged fragmentary view in lateral vertical section taken on the line 28*a*-2*a* of FIG. 28 showing the details of the support frame, main wheel, and the laterally offset position of the locking mechanism;

FIG. 29, a bottom plan view taken on the line 29—29 of FIG. 27 showing the mounting of the wheels to the support frame and the locking mechanism; and FIG. 30, a fragmentary view in longitudinal vertical section taken on the line 30—30 of FIG. 29 showing the details of the support frame, the mounting of the wheels to the support frame within the cutout chambers of the support frame, and the operation of the locking mechanism.

DETAILED DESCRIPTION OF THE ILLUSTRATED EMBODIMENTS

A first embodiment skate of the invention, a mono-wheel skate 40, is shown in FIGS. 1–20 which comprises a boot means, a frame means, a main wheel means, a main wheel mounting means, and a brake means.

The boot means includes a conventional front opening lace or buckling skate boot 43 for receiving a skater's foot (not shown) having an lower foot receiving portion 46, an upper leg and ankle support portion 49 hingedly connected thereto by means of a pair of hinge pins 52, and a plurality of buckles 55 to close boot 43. Lower foot receiving portion 46 includes a sole 58.

The frame means comprises a boot plate 61 and a support frame 64. Boot plate 61 is of such size and shape to fit sole 58, having a plate 67 with respective upper and lower surfaces 70 and 73, and integral, downwardly dependent front and rear keys 76 and 79 which extend from lower surface 73 along the longitudinal centerline thereof. Keys 76 and 79 include respective vertical portions 82 and 85, and outwardly flared portions 88 and 91, with a transverse hole 94 which extends through front key 76. Boot plate 61 is affixed to sole 58 of boot 43 by means of a plurality of counter-sunk screws 95 which extend through plate 67 and which thread into respective threaded inserts 96 molded into sole 58 of boot 43 (FIG. 2).

Support frame 64 comprises an upper portion 97, a front portion 100, a middle portion 103, and a rear portion 106. Front portion 100 is hollowed out, and middle portion 103 and rear portion 106 are also hollowed out to form respective front and central chambers 109 and 112 being defined by a pair of side walls 115 and 118 of support frame 64 which are interconnected by upper portion 97 and a front connecting portion 121 of support frame 64, which front connecting portion 121 separates front chamber 109 from central chamber 112. Respective front and rear key receiving slots 124 and 127 extend into upper portion 97 of support frame 64, having respective longitudinally disposed key receiving portions 130 and 133, and respective locking portions 136 and 139, key receiving slots 124 and 127 being longitudinally spaced to mate with keys 76 and 79 of boot plate 61. Locking portions 136 and 139 include respective vertical portions 142 and 145, and outwardly flared portions 148 and 151. A transverse hole 154 extends through front connecting portion 121 of support frame 64 which extends through front key receiving slot 124 thereof.

Boot plate 61 with attached boot 43 removably attaches to support frame 64 by inserting respective keys 76 and 79 into key receiving portions 130 and 133 until plate 67 thereof contacts upper portion 97 of support frame 64. Boot plate 61 is then moved longitudinally forwardly relative to support frame 64 such that front and rear keys 76 and 79 slide into respective locking portions 136 and 139 with respective outwardly flared portions 88 and 91 of front and rear keys 76 and 79 engaging locking portions 136 and 139 of front and rear key receiving slots 124 and 127. The shaft 157 of a spring ball retaining pin 160 is inserted through respective transverse holes 94 and 154 of front key 76 and front connecting portion 121 of support frame 64 to lock boot plate 61 with attached boot 43 to support frame 64 with a head 163 and spring ball 166 of retaining pin 160 juxtaposed front connecting portion 121 of support frame 64. Retaining pin 160 is removed by gripping a ring handle 169 thereof which is pivotally connected to head 163 and pulling.

The main wheel means comprises a main wheel 172 which supports the skater's weight during normal skating. Referring to FIG. 2, main wheel 172 comprises a wheel hub 175, a resilient tire 178, a pair of sealed roller or ball bearings 181, and a spacer tube 184. Wheel hub 175 includes an annular key slot 187 and a center hole 190. Wheel hub 175 is typically molded from a substantially rigid, thermoform or thermoset material such as polypropylene or nylon, though machining from aluminum or other such metal may likewise be done. Tire 178 is circumferentially disposed about wheel hub 175 and is typically keyed thereto such as by means of an annular key 193 of tire 178 which closely fits within key slot 187 of wheel hub 175 which helps to maintain tire 178 on wheel hub 175, particularly when side loads are applied thereto such as during trick skating. Tire 178 is typically a thermoform or thermoset material such as urethane or rubber, which material may be co-injection molded around wheel hub 175. Alternatively, tire 178 may be molded separately then stretched over wheel hub 175. Center hole 190 includes a smaller diameter center portion 196 and respective larger diameter bearing seats 199 and 202 into which are pressfit bearings 181 with spacer tube 184 therebetween, each of which bearings 181 abut a respective shoulder 205 and 208 formed between respective bearing seats 199 and 202 and center portion 196 to help align and position bearings 181.

Main wheel 172 is partially disposed within central chamber 112 between side walls 115 and 118 of support frame 64 (FIGS. 2 and 8). Main wheel 172 is pivotally mounted to support frame 64 by means of forked main pivot arm 211 which comprises an upper body 214 with a metal bushing 217 pressfit into a lateral hole 220 therethrough, and a pair of dependent legs 223 and 226 having respective coaxial, transverse holes 229 and 232 therethrough. Upper body 214 and legs 223 and 226 are of such a width as to fit between side walls 115 and 118 within central chamber 112 of support frame 64 with each of legs 223 and 226 straddling main wheel 172. A double threaded end main stud 235 laterally extends through respective transverse holes 238 and 241 of side walls 115 and 118 of support frame 64 and through bushing 217, with a respective low friction nylon washer 244 disposed on each side of upper body 214 of main pivot arm 211 between each of side walls 115 and 118 and upper body 214. A pair of locknuts 247 and flat washers 248 retain stud 235 while allowing free pivoting of main pivot arm 211.

Main wheel 172 is pivotally connected to forked main pivot arm 211 and the arcuate range of motion thereof being limited by means of a headed limiting clevis pin 250 which extends laterally through respective arcuate slots 253 and 256 in side walls 115 and 118, respective holes 229 and 232 of legs 223 and 226, spacer tube 184, and bearings 181 with a pair of external retaining rings 257 which maintain bearings 181 in place should the pressfit of them loosen with wheel hub 175. A pair of respective low friction nylon washers 259 are disposed on opposite sides of each of legs 223 and 226, with limiting clevis pin 250 being retained by means of an external retaining ring 260. Arcuate slots 253 and 256 are concentric about main stud 235 such that main pivot arm 211 can pivot about main stud 235 with limiting clevis pin 250 sliding along the length of arcuate slots 253 and 256 within the range of arcuate motion permitted thereby. Opposite end portions 262 and 265 of a compression spring 268 fit onto a pin 271 affixed to upper body 214 of main pivot arm 211 and into a bore 274 having a bottom surface 277 in upper portion 97 of support frame 64 so as to bias main pivot arm 211 and main wheel 172 downward until limiting clevis pin 250 reaches a respective lower ends 280 and 283 of arcuate slots 253 and 256, respectively, in a lowermost position. Spring 268 can be customized to match to the weight and the skating proficiency of the particular skater, and the type of skating which will be done such as trick skating, by changing spring 268 to one having a higher or lower spring constant. Likewise spring 268 can be customized using a spring which is preloaded by using a spring 268 having an undeflected length which is greater than the distance between upper body 214 of main pivot arm 211 at pin 271 and bottom surface 277 of bore 274 when main pivot arm 211 is in the lowermost position.

The brake means comprises a brake actuation wheel 286, a brake pivot arm 289, a brake adjustment assembly 292, and a caliper brake 295. Brake actuation wheel 286 is used to actuate caliper brake 295 but does none of the actual braking of a skater. Brake actuation wheel 286 comprises a wheel hub 298 made of any of the materials described for wheel hub 175, having an annular key 300 and a center hole 303 with a metal bushing 306 which is pressfit therein (FIG. 4). A resilient tire 309 made of any of the materials described for tire 178 is circumferentially disposed about wheel hub 298 and is typically keyed thereto as described for tire 178 such as by means of an annular key slot 312 of tire 309 which closely fits about annular key 300 of wheel hub 298 which helps to maintain tire 309 on wheel hub 298, particularly when side loads are applied thereto such as during trick skating.

Brake actuation wheel 286 is pivotally mounted to support frame 64 by means of brake pivot arm 289 which is partially disposed within central chamber 112 between side walls 115 and 118 of support frame 64 (FIGS. 4 and 8). Pivot arm 289 comprises a sheet metal main member 315 having respective legs 318 and 321, and a downwardly dependent U-shaped portion 324 interconnecting respective lower portions 327 and 330 of legs 318 and 321, an upper pivot tube 333 which interconnects respective upper portions 336 and 339 of legs 318 and 321, and an actuation lever 342. Pivot arm 289 is of such a width as to fit within central chamber 112 with each of respective lower portions 327 and 330 of legs 318 and 321 straddling brake actuation wheel 286. A pivot bolt 345 extends through respective lateral holes 348 and 351 in side walls 115 and 118, through respective upper portions 336 and 339 of legs 318 and 321, upper pivot tube 333, and a pair of washers 354 made of nylon or other suitable anti-friction material positioned between legs 318 and 321 and the respective side wall 115 and 118. A locknut 357 and a flat washer 360 retain bolt 345 in position allowing pivotarm 289 to pivot thereon. Brake actuation wheel 286 is attached to pivot arm 289 by means of a bolt 362 which extends through a pair of slots 363 and 366 through respective lower portions 327 and 330 of legs 318 and 321, through a metal spacer tube 369 disposed within bushing 306 of brake actuation wheel 286, with a pair of washers 372 made of nylon or other suitable anti-friction material disposed between brake actuation wheel 286 and respective legs 318 and 321, with flat washers 375, and secured against spacer tube 369 by a locknut 378. Brake actuation wheel 286 can be secured in any position along slots 363 and 366 of legs 318 and 321, respectively, by loosening locknut 378, sliding bolt 362 along slots 363 and 366, and retightening locknut 378. Spacer tube 369 maintains legs 318 and 321 at a fixed spacing when locknut 378 is tightened such that bolt 362 remains fixed in position along slots 363 and 366 of legs 318 and 321 with brake actuation wheel 286 free to rotate thereon without binding. This feature allows customization of the position at which brake actuation wheel 286 touches the ground (not shown) to begin braking as well as allowing for the use of larger or smaller diameter brake actuation wheels 286 depending on skater preferences.

Brake pivot arm 289 is resiliently mounted to support frame 64 by means of brake adjustment assembly 292, which comprises an extension spring 381, an adjustment bolt 384, and a locknut 387. Extension spring 381 includes a first end hook 390 which extends through a hole 393 in actuation lever 342 and a second end hook 396 which extends through a hole 399 in adjustment bolt 384, which adjustment bolt 384 extends through a non-threaded hole 402 in a downwardly protruding flange 405 of support frame 64 (FIG. 8). Locknut 387 is threaded onto adjustment bolt 384 to abut flange 405 so as to change the position of pivot arm 289 and brake actuation wheel 286 to customize the braking of caliper brake 295. In such a set-up, extension spring 381 remains unextended until force is applied to brake actuation wheel 286. However, a preload may be applied to extension spring 381 so as to increase the force needed to be applied to brake actuation wheel 286 to deflect pivot arm 289 during braking. This is accomplished by means of positioning the shaft 408 of a spring ball retaining pin 411, of similar design to retaining pin 160, through a respective pair of coaxial holes of a plurality of holes 414 and 415 through side walls 115 and 118 of support frame 64. Retaining pin 411 provides a lower positional limit, or starting point, for pivot arm 289 and likewise allows extension spring 381 to be preloaded by rotating locknut 387 while retaining adjustment bolt 384 from rotating such that adjustment bolt 384 moves longitudinally rearward and extension spring 381 extends so as to apply a desired amount of preload force of brake pivot arm 289 against retaining pin 411 through actuation lever 342.

Thus, brake adjustment assembly 292 allows for customization for each individual skater of both the preload and the position of brake actuation wheel 286 relative to the ground. Likewise, brake adjustment assembly 292 can compensate for the use of brake actuation wheels 286 of various diameters. Customization to the particular skater size and weight is also possible by changing extension spring 381 to a spring having a higher or lower spring constant and/or a different length. Spring 381 can also be adjusted for the type of skating which will be done, such as trick skating, and for the proficiency of the skater.

Caliper brake 295 comprises a pair of generally S-shaped brake arms 417 and a brake linkage 420. Each of brake arms 417 include a brake shoe end 423 and an actuation end 426 (FIGS. 9 and 9A). Brake arms 417 interlink in a scissor-like manner by means of recesses 429 and 432. Brake arms 417 are positioned with respective brake shoe ends 423 thereof straddling main wheel 172 and are pivotally connected together in such scissor-like manner at respective holes 435 and to support frame 64 by means of a headed clevis pin 438 which extends through a hole 441 through a rib 444 of support frame 64, flat washers 447, and an external retaining ring 450 (FIGS. 6, 6A, and 6B). Rib 444 may be integral with support frame 64 or, more typically, a separate piece which is attached thereto such as by means of a pair of bolts 453 threaded into respective ends 456 and 459 of rib 444. A pair of inwardly disposed circular brake shoes 462, each having a threaded stem 465 and attached brake pad 468, are attached to the brake shoe end 423 of brake arms 417 through respective brake arm holes 469, and through respective brake shoe holes 471 and 474 through side walls 115 and 118 of support frame 64 using a pair of tubular spacers 477, a pair of locknuts 480, and a pair of flat washers 483.

Brake linkage 420 comprises a tabbed connector plate 486, a compression spring 489, and a bolt 492. Connector plate 486 includes a transverse plate 495 and a pair of tabs 498 and 501 which extend normally from opposite end portions 504 and 507 thereof, which tabs 498 and 501 include respective transverse slots 510 and 513. Actuation ends 426 of brake arms 417 are connected to respective tabs 498 and 501 by means of a pair of headed pins 516 which extend through respective holes 519 through respective actuation ends 426 of brake arms 417 and through respective slots 510 and 513 of tabs 498 and 501 and which pins 516 are secured by means of respective external retaining rings 520. Slots 510 and 513 permit actuation ends 426 of brake arms 417 to laterally move during actuation of caliper brake 295. The respective recesses 432 in brake arms 417 allow actuation ends 426 thereof to attach on opposite horizontal sides of the respective tabs 498 and 501 so as to provide a more compact assembly and minimize side loads on clevis pin 438 for smooth, non-binding actuation of brake arms 417 of caliper brake 295. Connector plate 486 is resiliently connected to U-shaped portion 324 of pivot arm 289 by means of bolt 492 which extends through an oversized, clearance hole 522 through transverse plate 495 of connector plate 486 with compression spring 489 and a flat washer 525 therebetween, threads into a hole 528 in U-shaped portion 324, and is secured against rotation by means of a locknut 531.

Compression spring 489 allows resiliency in brake linkage 420 such that the force transmitted from brake actuation wheel 286 through pivot arm 289 and brake linkage 420 to caliper brake 295 is not applied abruptly. Clearance hole 522 allows non-binding movement of brake arms 417 and connector plate 486 relative to U-shaped portion 324 of pivot arm 289 during movement thereof by allowing bolt 492 to pivot slightly, particularly vertically, in clearance hole 522 during actuation of caliper brake 295.

Brake linkage 420 is adjustable by varying the depth of threading of bolt 492 into threaded hole 528 so as to permit caliper brake 295 to function properly when brake actuation wheel 286 is positioned anywhere along slots 363 and 366 of legs 318 and 321, respectively, or when different diameter brake actuation wheels 286 are utilized. Also, different springs 489 can be used having different lengths and/or spring constants to further customize the actuation characteristics of caliper brake 295.

When a rearward force is applied to each of actuation ends 426 of brake arms 417 each of brake shoe ends 423 close toward one other so as to clamp against main wheel 172. Main wheel 172 is typically provided with a flat radial braking surface 534 and 537 on main wheel hub 175 for brake pads 278 to grip (FIG. 2). Such rearward force is transmitted to actuation ends 426 of brake arms 417 from brake actuation wheel 286, through brake pivot arm 289, and brake linkage 420 to caliper brake 295 (FIG. 8A).

Roller skates 40 are typically propelled forward by a skater (not shown) utilizing a toe push-off means, a first version of which is a toe push-off wheel 540 (FIG. 11). Push-off wheel 540 is designed such that it will freely rotate in the skater's forward direction of travel but not in the opposite rotational direction. This allows the skater to push-off by contacting push-off wheel 540 against the ground and pushing rearward with the skater's leg (not shown) wherein the push-off wheel 540 does not rotate but rather is stationary on the ground surface 543. If push-off wheel 540 touches the ground surface 543 other than when it is being thrust rearwardly, push-off wheel 540 freewheels. This freewheeling feature of push-off wheel 540 helps to prevent the skater from tripping, such as is possible with a non-rotating fixed push-off means.

Toe push-off wheel 540 includes a wheel hub 546 having an outer circumferential key 549, an internal ratchet portion 552, and an annularly stepped hole 555 extending laterally therethrough FIGS. 12, 13, and 14). Wheel hub 546 is typically made from a substantially rigid, thermoform or thermoset plastic material such as polypropylene or nylon, though aluminum or other metal may likewise be used. A resilient tire 558 is circumferentially disposed about wheel hub 546 and is typically keyed thereto by means of an annular key slot 561 of tire 558 which helps to maintain tire 558 on wheel hub 546, particularly when side loads are applied thereto such as during trick skating. Tire 558 is typically made from a thermoform or thermoset plastic material such as urethane or rubber, and may be co-injection molded around wheel hub 546. Alternatively, tire 558 may be molded separately then stretched over wheel hub 546. Internal ratchet portion 552 of wheel hub 546 comprises a flat disk portion 564 having a plurality of laterally extending radial slots 567 therethrough. Stepped hole 555 comprises a middle axle hole 570, a pair of larger diameter cylindrical ratchet plate areas 573 and 576 on each side of ratchet portion 552, and a pair of larger diameter cylindrical bearing portions 579 and 582 defining annular shoulders 585 and 588. A flat washer 591 is disposed on each side of ratchet portion 552 in ratchet plate areas 573 and 576 and a pair of thin spring steel ratchet plates 594 and 597 are likewise disposed therein with one on each side of ratchet portion 552 against flat washers 591. Ratchet plates 594 and 597 have a respective pair of spring locking tabs 600 and 603, and 606 and 609 which face toward and are biased into radial slots 567. A sealed roller or ball bearing 612 is pressfit into each of bearing areas 579 and 582 which hold the locking tabs 600 and 603, and 606 and 609 of ratchet plates 594 and 597, respectively, in contact with ratchet portion 552 of wheel hub 546. Bearings 612 abut a respective shoulder 585 or 588 of wheel hub 546 to assist in the alignment and positioning of bearings 612 therein. An axle 621 which is threaded at opposite ends is disposed through push-off wheel 540 with ratchet plates 594 and 597 keyed thereto by means of a pair of keys 624. A pair of external retaining rings 627 maintain bearings 612 in place should the pressfitting thereof loosen. Toe push-off wheel 540 is mounted in a forward chamber 630 of support frame 64 with the ends of axle 621 extending through a pair of slots 633 and 636 in support frame side walls 115 and 118, respectively. A pair of tubular spacers 639 between external retaining rings 627 and support frame side walls 115 and 118, a pair of locktab washers 642, and a pair of locknuts 645 hold axle 621 in position in slots 633 and 636. Slots 633 and 636 allow push-off wheel 540 to be custom positioned for the particular skater. Also, forward chamber 630 has a sloped backwall 648 which is designed to accept larger or smaller push-off wheels 540, with the larger wheels being positioned farther rearward in slots 633 and 636 wherein sloped backwall 648 allows more room. This feature maintains the outer circumference of the push-off wheel 540 at the same longitudinal position relative to boot 43 for a consistent push-off feel. Axle 621 is affixed to support frame side walls 115 and 118 by means of locknuts 645 and locktab washers 642 which bear against tubular spacers 639 and external retaining rings 627 such that axle 621 does not rotate. Likewise, ratchet plates 594 and 597 do not rotate since they are keyed to axle 621 by means of keys 624. Wheel hub 546 and tire 558 are supported for rotation on axle 621 by means of bearings 612. In the forward rotational direction, tire 558 and wheel hub 546 rotate past locking tabs 600, 603, 606, and 609 of ratchet plates 594 and 597, respectively, which are outwardly flexed by the solid portions of flat disk portion 564 between radial slots 567 of wheel hub 546. However, rotation of wheel hub 546 with tire 558 in the opposite rotational direction is prevented since the ends of the respective locking tabs 600, 603, 606, and 609 engage the walls defining radial slots 567 of wheel hub 546 for pushing off as shown in FIG. 11.

A second version of the toe push-off means comprises an arcuate toe push-off piece 651 which comprises an arcuate front plate 654, sidewalls 657 and 660, and a gripping pad 663 (FIGS. 1 and 5). Arcuate front plate 654 is contoured to optimize the rolling action as the skater pushes off in a linear stride (FIG. 19). Typically push-off piece 651 is of such curvature and width so as to fit over push-off wheel 540 with sidewalls 657 and 660 closely adjacent support frame side walls 115 and 118 to provide lateral support for push-off piece 651. Sidewalls 657 and 660 may be integral with front plate 654 such as if injection molded from a thermoset or thermoform plastic like polypropylene, polyvinyl chloride, or other medium or high impact plastic, or may be separate metal pieces affixed together such as by welding or brazing. Sidewalls 657 and 660 have respective slots 666 and 669 therein to clear the ends of axle 621, the pair of locknuts 645, and the tablock washers 642, without interfering with any of the possible positions of axle 621. Sidewalls 657 and 660 are sufficiently thin and flexible to allow expanding the distance between sidewalls 657 and 660 to slide push-off piece 651 over the ends of axle 621 into an operative position over push-off wheel 540, if present, or can be used without push-off wheel 540. Push-off piece 651 is held to support frame side walls 115 and 118 by means of a plurality of bolts 678 which extend through pairs of slots 681 and 684 in sidewall 657, and slots 687 and 690 in sidewall 660, and threaded into support frame sidewalls 115 and 118, respectively. Slots 681, 684, 687, and 690 permit push-off piece 651 to be moved and retained in a more frontward or rearward position depending on the preference of the particular skater. Gripping pad 663 is typically made of urethane, rubber, or other similarly gripping material which is affixed to arcuate front plate 654 such as by using an adhesive or rivets (not shown). Gripping pad 663 allows a skater to push-off with greater force against the ground than would otherwise be possible due to the increased frictional coefficient with the surface of the ground.

In the first or mono-wheel embodiment of the invention, the relative positioning of the toe push-off means and main wheel 172 allows a more fluid, upright arcuate motion of the skate as it is rolled from main wheel 172 onto push-off piece 651 or push-off wheel 540 (FIGS. 11 and 19). However, while either toe push-off means is particularly advantageous for use on the mono-wheel embodiment of the invention, both may be used on the other roller skate embodiments of the invention including in-line roller skates.

A rail guard 693 used for sliding down stair railings (not shown) without damaging skate 40 nor the railing can be used which integrates with push-off wheel 540 or push-off piece 651 (FIGS. 1, 3, and 3A). Rail guard 693 comprises an arcuate body 696 and a pair of flanges 699 and 702 which extend upwardly from respective edges 705 and 708 thereof at such a distance apart as to extend closely adjacent support frame sidewalls 115 and 118. Edges 705 and 708 are radiused and arcuate body 696 of sufficient thickness so as to wear well without excessive thinning at edges 705 and 708. Rail guard 693 is attached to support frame 64 by means of a plurality of bolts 711 which extend through flanges 699 and 702 and which thread into support frame sidewalls 115 and 118, and front connector portion 121 of support frame 64.

Rail guard 693 is typically designed. to accept a rock guard 714 which removably snaps over rail guard 693 to aid in preventing debris from collecting in front of and hitting main wheel 172, particularly during off-road skating. Rock guard 714 is of a semicircular, box-like construction having a rock-deflecting lower wall 717 and a pair of sidewalls 720 and 723 with respective inwardly directed flanges 726 and 729. Flanges 726 and 729 include respective hook portions 732 and 735 which snap-fit over edges 705 and 708 of rail guard 693 into respective grooves 738 and 741 thereof. This snap-fitting arrangement allows easy changeover from using rail guard 693 alone to using with rock guard 714 without the use of tools.

A second embodiment skate of the invention, an in-line roller skate 744, is shown in FIGS. 21 and 22, which has a support frame 747 similar to support frame 64 but supporting a plurality of wheels 750 of similar construction to main wheel 172, though of a smaller diameter. Wheels 750 are attached to support frame 747 by means of a plurality of bolts 751, locknuts 752, and flat washers 753, with push-off wheel 540 optionally placed in the furthest forward position or other desired position. A standard drag-type brake pad 754 is attached to support frame 747 such as by using a bolt 756 and flat washer 759 which thread into a rear portion 762 of support frame 747. Optionally, a calliper brake (not shown) similar to that of mono-wheel skate 40 can be utilized rather than brake pad 754 wherein the rearmost of wheels 750 is pivotally connected to support frame 747 and actuates the caliper brake to slow the second rearmost of wheels 750 in a similar fashion to mono-wheel skate 40.

Support frame 747 utilizes the same quick release system wherein boot 43 can be quickly attached to and released from support frame 747. Boot plate 61 includes plate 67 with attached front and rear keys 76 and 79 which fit into a front keyway slot 765 and a rear keyway slot 768, respectively, through a pair of key holes 771 and 772 thereof, and which lock in respective locking portions 773 and 774 which include respective vertical portions 775 and 776, and outwardly flared portions 777 and 780. Outwardly flared portions 777 and 780 vertically retain front and rear keys 76 and 79, respectively, in their respective keyway slots 765 and 768. A retaining pin 160 extends laterally through a hole 781 through support frame 747, and hole 94 of vertical portion 82 of front key 76, which pin 160 longitudinally retains keys 76 and 79 in respective locking portions 773 and 774 of keyway slots 765 and 768.

In FIGS. 23 and 24 is shown a third embodiment skate of the invention, an ice skate 783, which includes a support frame 786 of similar construction to support frame 747 but which supports an ice blade 789 which fits within a slot 792 extending the length thereof. Ice blade 789 is held in slot 792 by means of a plurality of bolts 795, flat washers 798, and locknuts 801. Support frame 786 utilizes the same quick release system wherein boot 43 can be quickly attached to and released from support frame 786. Boot plate 61 includes plate 67 with attached front and rear keys 76 and 79 which fit into a front keyway slot 804 and a rear keyway slot 807, respectively, through a pair of key holes 810 and 813 and which lock in respective locking portions 814 and 815 which include respective vertical portions 816 and 817, and outwardly flared portions 818 and 819. Outwardly flared portions 818 and 819 vertically retain front and rear keys 76 and 79, respectively, in their respective keyway slots 804 and 807. A retaining pin 160 extends laterally through a hole 820 through support frame 786 and hole 94 of vertical portion 82 of front key 76, which pin 160 longitudinally retains keys 76 and 79 in respective locking portions 814 and 815 of keyway slots 804 and 807.

In FIGS. 25 and 26 is shown a fourth embodiment skate of the invention, a tank tread skate 822, which includes support frame 747, a plurality of tireless wheels 825, a unidirectionally rolling, tireless front wheel 826, and a continuous treaded belt 828. Wheel 825 is of the same general construction as wheel 172 without tire 178, which has a modified wheel hub 831 adapted to receive treaded belt 828. Wheels 825 and 826 are mounted to support frame 747 by means of a plurality of bolts 751, locknuts 752, and flat washers 753. Treaded belt 828 has a body 834 of generally rectangular cross-section with an inner centering bulge 837 and a plurality of transverse outer ribs 840 which grip the ground surface 543. Centering bulge 837 rides in a matching annular depression 843 in the outer circumference of wheel hub 831 to maintain treaded belt 828 laterally in position during skating. Front wheel 826 is of a construction similar to push-off wheel 540 but without tire 558, and with a wheel hub 844 having an outer circumference with an annular depression 845 similar to that of wheel hub 831 so as to accept treaded belt 828. Wheel 826 allows the same straight forward, upwardly arcuate skating stroke of the other embodiments of the skate, rather than a sideways stroke, which aids in reducing the amount and frequency of side load applied to treaded belt 828 for reduced maintenance and wear thereof. Treaded belt 828 is especially well adapted for off-road use since rocks and other debris are less likely to contact and jam in front of the individual wheels 825 and 826 than if treaded belt 828 were not present. Treaded belt 828 also provides some cushioning of bumps, also riding above some indentations in the ground. For braking, brake pad 754 can be utilized as done for inline roller skate 744. If desired, a caliper brake (not shown) can be adapted for use on tank tread skate 822 as explained for in-line roller skate 744, wherein the rearmost of wheels 825 is pivotally mounted to support frame 747 and actuates the caliper brake which brakes the second to the rearmost of wheels 825.

A fifth embodiment skate of the invention, a mono-wheel skate 846, is shown in FIGS. 27–30 which is similar to mono-wheel skate 40 except for utilizing a modified support frame 849 adapted for mounting a main wheel 852 directly thereto without using forked main pivot arm 211, and for the use of a unidirectional locking mechanism 855 to permit main wheel 852 to roll in the forward rotational direction, but not in the reverse rotational direction. This allows directly thrusting forward using main wheel 852 rather than or in conjunction with push-off wheel 540 or push-off piece 651 so as to allow a skater to use an even, more efficient straight line stroke in the direction of travel than mono-wheel skate 40, rather than the less efficient side push-off stroke.

Main wheel 852 comprises a wheel hub 858 which is similar to wheel hub 175, having an outer circumferential key slot 861 and a center hole 864, but further including an integral main gear 867. Main gear 867 includes a plurality of spur teeth 870, or other suitable type of teeth. Wheel hub 858 is typically made from a substantially rigid, thermoform or thermoset plastic material such as polypropylene or nylon, though aluminum or other metal may likewise be used. Tire 178 is circumferentially disposed about wheel hub 858, and is typically keyed thereto by means of annular key slot 861 which helps to maintain tire 178 on wheel hub 858. Within center hole 864 are pressfit a pair of bearings 181 which each abut a respective shoulder 876 or 879 to assist in the alignment and positioning of bearings 181.

Main wheel 852 is disposed within a main chamber 882 of support frame 849 between a pair of side walls 885 and 888 (FIGS. 28 and 30). Main wheel 852 is rotationally mounted on a fixed rotational axis directly to support frame 849 by means of clevis pin 250 which extends through transverse holes 892 and 895 through respective side walls 885 and 888, a pair of low friction nylon spacer washers 889, and is retained by retaining ring 260. With such mounting the only cushioning provided to the skater is by the resiliency of tire 178. A more resilient mounting of main wheel 852 to support frame 849 can be accomplished by using a pair of resilient grommets (not shown) which are disposed in oversize versions (not shown) of holes 892 and 895 about clevis pin 250 such that clevis pin 250 has some amount of freedom to move.

Unidirectional locking mechanism 855 comprises a locking gear 891, a lever arm 894, an idler gear 897, and a compression spring 900. Locking gear 891 includes a disc-shaped body 901 and a plurality of radially extending spur teeth 903 or other suitable type of teeth, with a central hole 906 and a semi-annular side slot 909 in body 901 which extends a predetermined angular distance about central hole 906. Locking gear 891 is mounted within main chamber 882 of support frame 849 by means of a headed pin 915 which extends transversely through side walls 885 and 888 of support frame 849 and which is retained in place by a retaining ring 918. A sleeve 921 is disposed about pin 915 between side wall 885 of support frame 849 and locking gear 891 to retain locking gear 891 closely adjacent side wall 888. Locking gear 891 is laterally aligned with gear 867 of wheel hub 858 but teeth 903 of locking gear 891 do not engage teeth 870 of main gear 867 of wheel hub 858. A headed pin 924 is pressfit into and through side wall 888 of support frame 849 with an end portion 927 thereof extending into semi-annular side slot 909 of locking gear 891. Pin 924 and side slot 909 limit the range of rotation of locking gear 891 to a predetermined limit which spreads the wear over a number of teeth 903 versus if locking gear 891 were non-rotating. Locking gear 891 can also be spring loaded (not shown) providing resistance and cushioning to further spread the wear over a number of teeth 903.

Lever arm 894 is of a generally flat, angled configuration having a midportion 930, a dependent pivot arm 933, and a dependent spring carrying arm 936 having a bent spring carrying tab 939 with a spring pilot stub 942 affixed thereto. Lever arm 894 fits within a recess 945 of side wall 888 of support frame 849 so as to be generally flush with the inner surface thereof, being pivotally mounted to side walls 885 and 888 by means of a headed pin 948 which extends transversely through side walls 885 and 888 of support frame 849 and which is retained in place by a retaining ring 951. A sleeve 954 is disposed about pin 948 between side wall 885 and lever arm 894 to retain lever arm 894 adjacent side wall 888 within recess 945 thereof. Spring 900 is disposed against tab 939 about pilot stub 942 of carrying arm 936 and partially within a bore 957 of support frame 849 so as to bias lever arm 894 vertically downwardly pivoting about headed pin 948.

Idler gear 897 includes a disk-shaped body 960 and a plurality of radially extending spur teeth 963 or other suitable type of teeth, with a central hole 966, and a counterbore 969 in a side 972 of body 960. A metal bushing 975 is pressfit within central hole 966 of idler gear 897, which is rotationally mounted to midportion 930 of lever arm 894 by means of a rivet 978 for rotation on bushing 975. Idler gear 897 is laterally aligned with main gear 867 of wheel hub 858 and locking gear 891, with spring 900 biasing lever arm 894 such that teeth 963 of idler gear 897 engage teeth 870 of main gear 867 of wheel hub 858, and teeth 903 of locking gear 891.

Mono-wheel skate 846 is propelled forward by a skater utilizing push-off wheel 540, push-off piece 651, and/or using main wheel 852. Main wheel 852 in conjunction with unidirectional locking mechanism 855 is designed such that it will freely rotate in the skater's forward direction of travel but not in the opposite rotational direction. This allows the skater to push-off by contacting main wheel 852 against the surface of the ground (not shown) and pushing rearward with the skater's leg (not shown) wherein main wheel 852 does not rotate so as to propel the skater forward. If main wheel 852 touches the ground other than when it is being pushed rearwardly relative to the ground, it freewheels to help prevent the skater from tripping and possibly falling. Spring 900 can be customized to match to the weight of the particular skater by changing spring 900 to one with a higher or lower spring constant and/or by changing the length, or preload, thereof. Likewise spring 900 can be adjusted for the type of skating which will be done such as for trick skating, and for the proficiency of the skater.

Many variations of the roller skates of the invention are possible while staying within the same inventive concept. For example, the compression springs can be replaced such as by gas springs or solid members of a resilient material, and the extension springs replaced by elastic bands. Other types of brake mechanisms can be used such as disc brakes and drag brakes which rub against the outer portion of the tire. The push-off wheel can utilize a roller clutch rather than the ratchet mechanism. The support frames and other metal components can be injection molded from polypropylene or other such thermoplastic or thermoset material, or machined from such material, or die cast.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A multi-functional skate for attachment to the foot of a skater for skating on a ground surface, comprising:

a boot for receiving and holding the skater's foot, said boot which includes a upper support portion and a lower portion having a lowermost sole;

a frame attachable to the sole of said boot for rotationally connecting at least one wheel;

a main wheel rotationally connected to said frame for rollably supporting the skater upon the ground surface;

a brake actuation wheel rotationally disposed spaced from said main wheel, said brake actuation wheel being interconnected with said frame for movement relative to said main wheel;

a brake mechanism interconnected with said brake actuation wheel which is actuated by tilting said boot and said frame so as to apply force to said brake actuation wheel against the ground surface to induce movement of said brake actuation wheel relative to said main wheel wherein said brake mechanism bears against said main wheel to provide braking thereof without braking of said brake actuation wheel; and wherein said main wheel has a substantially flat, annular braking surface on each side thereof, and said brake mechanism comprises a caliper brake having a pair of pivotally connected arcuate braking arms each having a brake pad attached thereto configured to bear against one of said braking surfaces during braking and opposite ends operatively connected to said brake actuation wheel for movement therewith.

2. A skate according to claim 1, wherein the brake actuation wheel is interconnected with the frame using a cantilevered brake actuation arm which is pivotally connected to said frame with the brake actuation wheel rotationally connected to said brake actuation arm.

3. A skate according to claim 1, wherein the brake actuation arm is biased in a downward direction by a spring mechanism which is operatively connected to the brake actuation arm and to the frame.

4. A skate according to claim 1, wherein the spring mechanism is adjustable to apply a desired preset force to the brake actuation arm.

5. A skate according to claim 1, wherein:

the spring mechanism can be preloaded so as to provide a higher initial force to the brake actuation arm; and the range of motion of said brake actuation arm is confinable for travel only within presetable limits.

6. A multi-functional skate for attachment to the foot of a skater for skating on a ground surface, comprising:

a boot for receiving and holding the skater's foot, said boot which includes a upper support portion and a lower portion having a lowermost sole;

a frame attachable to the sole of said boot for rotationally connecting at least one wheel;

a main wheel rotationally connected to said frame for rollably supporting the skater upon the ground surface;

a toe push-off means attached to said frame at a toe end of the boot; and wherein said toe push-off means is a longitudinally arcuate member having an outer peripheral surface and which is attachable to a front portion of the frame so as to curve around the toe end of said boot and said front portion of said frame such that said outer peripheral surface is engageable with the ground surface for the skater to propel forward.

7. A multi-functional skate for attachment to the foot of a skater for skating on a ground surface, comprising:

a boot for receiving and holding the skater's foot, said boot which includes a upper support portion and a lower portion having a lowermost sole;

a frame attachable to the sole of said boot for rotationally connecting at least one wheel;

a main wheel rotationally connected to said frame for rollably supporting the skater upon the ground surface;

a toe push-off means attached to said frame at a toe end of said boot; and wherein said toe push-off means is a unidirectionally rolling locking toe wheel having an outer peripheral surface and which is rotatably connectable to a front portion of said frame adjacent the toe end of said boot, which locking wheel freewheels in a forward rotational direction and locks in a reverse rotational direction, said outer peripheral surface being engagable with the ground surface for the skater to propel forward.

8. A multi-functional skate for attachment to the foot of a skater for skating on a ground surface, comprising:

a boot for receiving and holding the skater's foot, said boot which includes a upper support portion and a lower portion having a lowermost sole;

a frame attachable to the sole of said boot for rotationally connecting at least one wheel;

a main wheel rotationally connected to said frame for rollably supporting the skater upon the ground surface;

a concave rail guard having a concave portion with an outer surface configured for sliding along stair rails is connected to said frame being partially disposed within a matching concave cutout in a lower forward portion of said frame; and wherein a rock guard is connected to said frame forward of said main wheel, said rock guard having a downwardly and rearwardly angled lower surface for deflecting rocks and other debris downwardly and away from said main wheel such that the debris does not get caught in front of said main wheel, said rock guard being removably connectable to said rail guard so as to cover said concave portion thereof.

9. A multi-functional skate for use by a person on the ground surface, comprising:

a boot for receiving and holding a skater's foot, said boot having a bottom, a toe end, and a heel end;

a frame attachable to the bottom of said boot for rotationally supporting a wheel;

a main wheel disposed below the bottom of said boot substantially parallel thereto and intermediately positioned between said toe and heel ends, said main wheel being rotationally interconnected with said frame;

a brake actuation wheel rotationally disposed spaced from said main wheel, said brake actuation wheel being interconnected with said frame for movement relative to said main wheel;

a brake mechanism interconnected with said brake actuation wheel which is actuated by tilting said boot and frame to apply force to said brake actuation wheel against the ground to induce movement of said brake actuation wheel relative to said main wheel wherein said brake mechanism bears against said main wheel to provide braking thereof without braking said brake actuation wheel;

wherein said main wheel is the only wheel which contacts the ground when the bottom of said boot is parallel thereto so as to comprise a mono-wheel skate; and wherein said main wheel has a substantially flat, annular braking surface on each side thereof, and said brake mechanism comprises a caliper brake having a pair of pivotally connected arcuate braking arms each having a brake pad attached thereto configured to bear against one of said braking surfaces during braking and with opposite ends operatively connected to said brake actuation wheel for movement therewith.

* * * * *